US008531115B2

(12) United States Patent
Blanchard et al.

(10) Patent No.: US 8,531,115 B2
(45) Date of Patent: Sep. 10, 2013

(54) APPARATUS AND METHOD FOR BYPASSING FAILED LEDS IN LIGHTING ARRAYS

(75) Inventors: David L. Blanchard, Oskaloosa, IA (US); Myron Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 413 days.

(21) Appl. No.: 12/817,361

(22) Filed: Jun. 17, 2010

(65) Prior Publication Data

US 2011/0006689 A1 Jan. 13, 2011

Related U.S. Application Data

(60) Provisional application No. 61/218,320, filed on Jun. 18, 2009.

(51) Int. Cl.
*H05B 37/00* (2006.01)

(52) U.S. Cl.
USPC ..... 315/185 R; 315/122; 315/307

(58) Field of Classification Search
USPC ..... 315/185 R, 186, 192, 193, 119, 121, 315/122, 291, 307, 308
See application file for complete search history.

(56) References Cited

U.S. PATENT DOCUMENTS

| | | | |
|---|---|---|---|
| 5,105,347 | A | 4/1992 | Ruud et al. |
| 5,906,425 | A | 5/1999 | Gordin et al. |
| 6,402,337 | B1 | 6/2002 | LeVasseur et al. |
| 6,530,675 | B1 | 3/2003 | Van Etten |
| 6,543,911 | B1 | 4/2003 | Rizkin et al. |
| 6,679,621 | B2 | 1/2004 | West et al. |
| 6,814,470 | B2 | 11/2004 | Rizkin et al. |
| 6,899,443 | B2 | 5/2005 | Rizkin et al. |
| 6,951,418 | B2 | 10/2005 | Rizkin et al. |
| 7,093,961 | B2 | 8/2006 | Bentley et al. |
| 7,300,327 | B2 | 11/2007 | Bolta et al. |
| D571,495 | S | 6/2008 | Berns et al. |
| D589,196 | S | 3/2009 | Stone et al. |
| 7,503,669 | B2 | 3/2009 | Rizkin et al. |
| 7,618,163 | B2 | 11/2009 | Wilcox |
| 7,744,246 | B2 | 6/2010 | Rizkin et al. |
| 7,976,199 | B2 | 7/2011 | Berns et al. |
| 2002/0118542 | A1 | 8/2002 | LeVasscur |
| 2003/0210555 | A1 | 11/2003 | Cicero et al. |

(Continued)

FOREIGN PATENT DOCUMENTS

| | | | |
|---|---|---|---|
| WO | WO 01/86198 | A1 | 11/2001 |
| WO | WO 2008/123960 | A1 | 10/2008 |
| WO | WO2010/042186 | A2 | 4/2010 |

OTHER PUBLICATIONS

"3021/3023 BuckPuck—Wide Range LED Power Moduoe", LuxDrive by LEDynamics, Randolph, Vermont, Jul. 2005—Rev. 2.3, Document COM-DRV-3021-00, 9 pages.

(Continued)

*Primary Examiner* — David H Vu
(74) *Attorney, Agent, or Firm* — McKee, Voorhees & Sease, P.L.C.

(57) ABSTRACT

An apparatus, method and system for controlling one or multiple lighting sources such as those powered by driver circuits or voltage splitting methods, to provide an alternative current path around a failed lighting source when one or more individual lighting sources fail.

33 Claims, 27 Drawing Sheets

(56) References Cited

U.S. PATENT DOCUMENTS

| | | | | |
|---|---|---|---|---|
| 2005/0068765 | A1 | 3/2005 | Ertze Encinas et al. | |
| 2006/0291218 | A1 | 12/2006 | Pazula | |
| 2008/0037239 | A1 | 2/2008 | Thomas et al. | |
| 2008/0084697 | A1 | 4/2008 | Eberhard | |
| 2008/0192480 | A1 | 8/2008 | Rizkin et al. | |
| 2008/0273333 | A1 | 11/2008 | Berns et al. | |
| 2009/0284966 | A1 | 11/2009 | Crookham et al. | |
| 2010/0002432 | A1 | 1/2010 | Romano | |
| 2010/0060175 | A1* | 3/2010 | Lethellier | 315/164 |
| 2010/0103672 | A1 | 4/2010 | Thomas et al. | |
| 2010/0123399 | A1* | 5/2010 | Bollmann et al. | 315/122 |
| 2010/0134018 | A1* | 6/2010 | Tziony et al. | 315/122 |
| 2010/0290225 | A1 | 11/2010 | Rizkin et al. | |
| 2011/0006689 | A1 | 1/2011 | Blanchard et al. | |

OTHER PUBLICATIONS

"Bollards and Pagoda Lights at Deep Discount", Arcadian Lighting, [retrieved on Apr. 29, 2007 from the Internet: http://www.arcadianlighting.com/bollard-and-pagoda-lights.html], 4 pages.

"Lighting Answers—Light Pollution", NLPIP, Lighting Research Center, vol. 7, Issue 2, Mar. 2003 (revised Feb. 2007), 22 pages.

"LUXEON Radiatin Patterns" Phillips Lumileds Lighting Company, [retrieved on May 1, 2007 from the Internet: hyttp://www.lumileds.com/technology/radiationpatters.cfm], 1 page.

Paulin, Douglas, "Full Cutoff Lighting: The Benefits", www.iesna.org, Apr. 2001, 3 pages.

"100W TRC-100DS Dimming Series—Switch Mode LED Drives—Constant Current", Thomas Research Products, Innovative & Energy Saving Lighting Controls, Huntley, Illinois, 3 pages, Jan. 2011.

"CIE Technical Report—Glare Evaluation System for Use within Outdoor Sports and Area Lighting", CIE 112-1994, 15 pages, Jan. 1994.

"Control-Link", Musco Sports Lighting, LLC, www.control-link.com, 2011, 1 page, Control-Link Brochure, © 2007, 9 pages, Dec. 2005.

"Cree XLamp XP-E LEDs"—Product Family Data Sheet, Durham, North Carolina, www.cree.com/xlamp, 2008-2010, 16 pages [Basic content first published in 2008, earlier than earliest listed priority date of present application].

"IESNA Lighting Education—Fundamental Level", IESNA ED-100, Illuminating Engineering Society of North America, 3 pages, Jan. 2000.

"Light Trespass: Research, Results and Recommendations", The Lighting Authority, Prepared by the Obtrusive Light Subcommittee of the IESNA Roadway Lighting Committee, IESNA TM-11-2000, , Dec. 2000, 15 pages.

"LUXEON Emitter Technical Data Sheet DS25", Philips Lumileds Lighting Company, Mar. 2006, 19 pages.

"MIRO", Anomet Inc., 2006, 2 pages. [at least as early as Dec. 2006].

"Simple Guidelines for Lighting Regulations for Small Communities, Urban Neighborhoods, and Subdivisions", International Dark-Sky Association—The Nightscape Authority, www.darksky.org, Tucson, Arizona, Jun. 2007, 2 pages.

"Thermal Design Using LUXEON Power Light Sources", Philips Lumileds Lighting Corporation, Application Brief AB05, Jun. 2006, 12 pages.

* cited by examiner

Graph of $V_{Toff}$, $\alpha V_{Toff}$, Equations (17) and (25) with $p$ = 1.

Graph showing $V_{trig}$, $V_{SS}$, and $V_{latch}$ with $p$ = 1.

LED Required Supply Voltage (Vsupply) when $m = 10$, $p = 1$, and $0 \leq q \leq 5$.

Power Supply Overhead Voltage required for number of LED's in Sub-String with $q = 1$.

Active Single LED Sub-String For Active 1-LED, OLPC, and ZOLPC Voltages versus Current Active Single LED Sub-String For Active 1-LED, OLPC, and ZOLPC Power Dissipation versus Current Three - LED Sub-String For Active 3-LED's, OLPC, and ZOLPC Voltages versus Current Three-LED Sub-String For Active Three-LED's, OLPC, and ZOLPC
Power Dissipation vs. Current

APPARATUS AND METHOD FOR BYPASSING FAILED LEDS IN LIGHTING ARRAYS

CROSS-REFERENCE TO RELATED APPLICATIONS

This application claims priority under 35 U.S.C. §119 to provisional application Ser. No. 61/218,320 filed Jun. 18, 2009, herein incorporated by reference in its entirety.

I. BACKGROUND OF INVENTION

A. Field of Invention

The present invention relates to methods of controlling multiple lighting sources such as those powered by driver circuits and voltage splitting methods, which provides alternative failure modes when one or more individual lighting sources fail.

B. Problems in the Art

LED lighting often consists of an array of LEDs comprising a number of LEDs connected in series to form a string of LEDs, and a number of strings of LEDs connected in parallel. The array may be conveniently comprised in a single fixture, such as found in overhead lighting, or may be spread out among two or more fixtures such as found in pathway lighting.

The electro-optic properties of LEDs are such that the LED functions best when current through the LED rather than voltage applied across the LED is controlled. Connecting a large number of LEDs in a series string results in a relatively low amperage and relatively high total voltage drop across the string. This is beneficial for lighting circuits using multiple LEDs. However, this has the disadvantage that a single LED open circuit failure will prevent current from flowing through all other LEDs connected in series, resulting in the elimination of the illumination provided by all remaining functional LEDs in that series string. This severely reduces the illumination produced by the LED array.

Therefore, many opportunities exist for improving the current state of lighting using multiple LEDs or other solid state sources. It is the intention of this invention to solve or improve over such problems and deficiencies in the art.

II. SUMMARY OF THE INVENTION

It is therefore a principle object, feature, advantage, or aspect of the present invention to improve over the state of the art or address problems, issues, or deficiencies in the art.

Further objects, features, advantages, or aspects of the present invention include an apparatus, method, or system which provides a relatively inexpensive electronic circuit to be placed in parallel with a single LED or with one or more strings of LEDs that will detect an open LED failure and provide an alternate current path around the LED or string(s) of LEDs.

These and other objects, features, advantages, or aspects of the present invention will become more apparent with reference to the accompanying specification and claims.

A method according to one aspect of the invention comprises automatically detecting an open LED failure and providing an alternate current path around the LED or a string or strings of LEDs including the open LED failure. Optionally, the LED or string(s) can be in a fixture or fixtures each containing multiple LEDs.

Another method according to one aspect of the invention comprises automatically detecting an open LED failure and providing an alternate current path. Said current path may be around the LED or around a string or strings of LEDs (including the open LED failure) which are used in a series of individual fixtures. Said individual fixtures may be part of a distributed array of LEDs within a plurality of fixtures which may include one or more LEDs in each fixture.

An apparatus according to one aspect of the invention comprises an alternative current path circuit placed in parallel with an LED or a string of LEDs, the alternative current path circuit being substantially inactive, and including components which are substantially inactive except for small leakage and bias current in absence of a condition indicative of an open LED failure, but becoming automatically active to pass at least substantially most of the operating current if a condition indicative of an open LED failure is sensed by the circuit. The components can include a transistor to switch between inactive and active states. The components can function to latch the circuit into an active state until automatic sensing of a condition pre-designed to unlatch.

Another aspect of the invention comprises a method of designing an alternative current path circuit, adapted for placement in parallel with an LED or string of LEDs, to be essentially inactive until a condition indicative of an open LED failure is sensed, and then automatically becoming active to bypass that LED or the string of LEDs including that LED, with substantially all the operating current. The method includes techniques for determining and setting a triggering voltage for automatic triggering of an active state for the circuit.

III. BRIEF SUMMARY OF THE DRAWINGS

FIG. 1 shows an open LED protection circuit according to one exemplary embodiment of the invention.

FIGS. 2A-B show open LED protection circuits using two transistors and resistors R1-R3 according to other exemplary embodiments of the invention.

FIGS. 3A-B show open LED protection circuits using two transistors, resistors R1-R3, and zener diode D1 according to other exemplary embodiments of the invention.

FIGS. 4A-B show open LED protection circuits using two transistors and zener diode D1.

FIGS. 5A-B show an ideal LED and its voltage/current relationship.

Figure 10A:
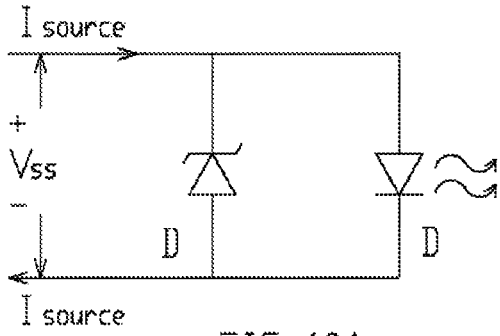
Figure 10B:
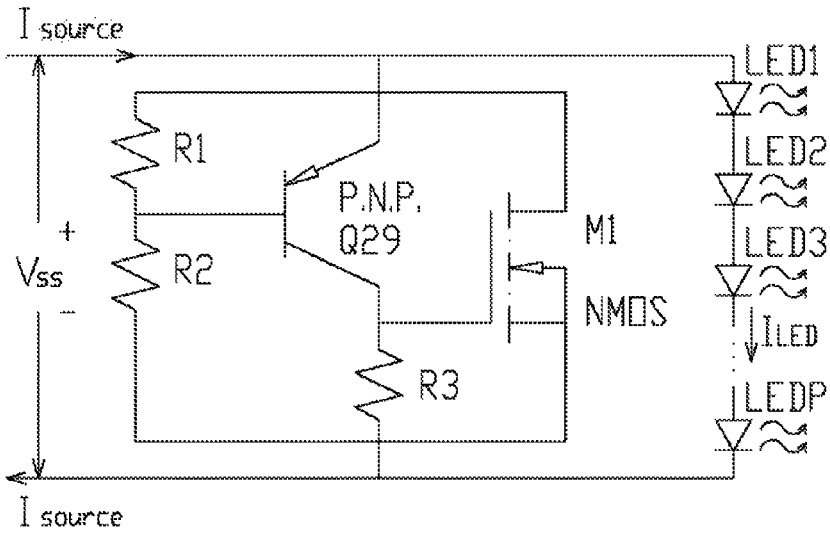
Figure 10C:
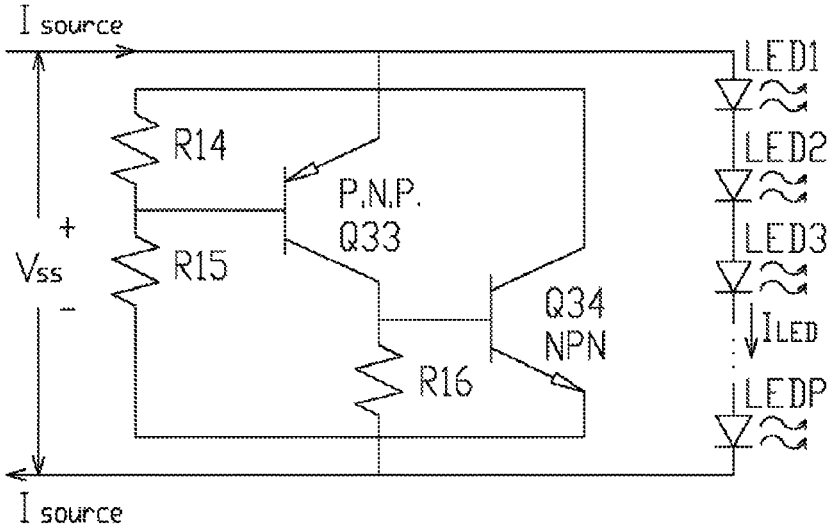

FIGS. 10A-C show three alternative circuit arrangements according to exemplary embodiments of the present invention.

FIG. 10A shows a circuit using a zener diode.

Figure 2A:
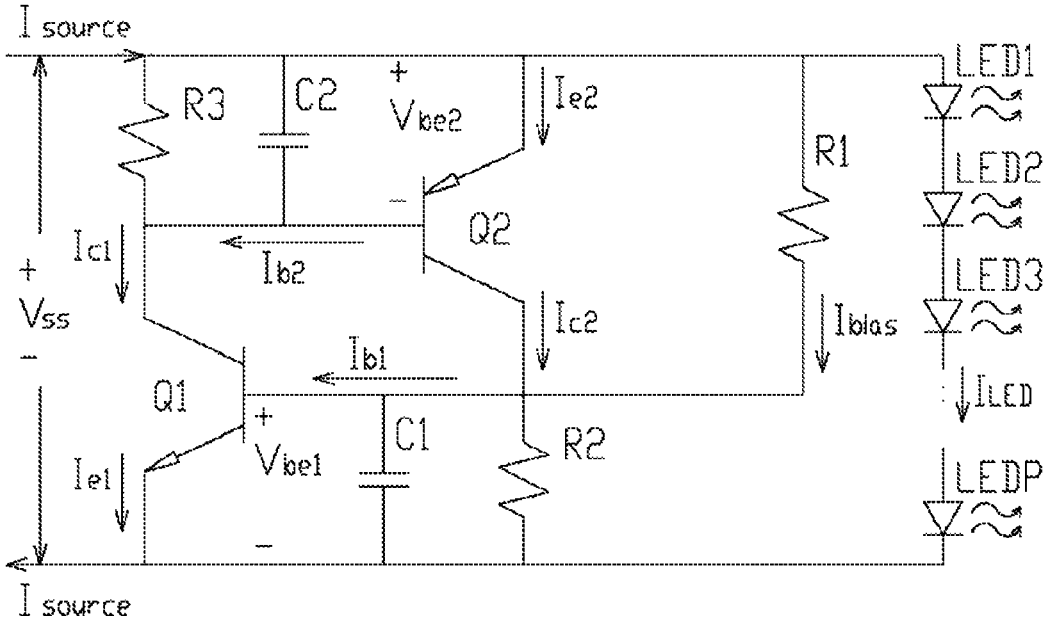

FIG. 10B is a circuit that functions similarly to FIG. 2A using a PNP transistor and an NMOS FET.

FIG. 10C is a circuit that functions similarly to FIG. 2A using a PNP transistor and an NPN transistor.

Figure 11A:
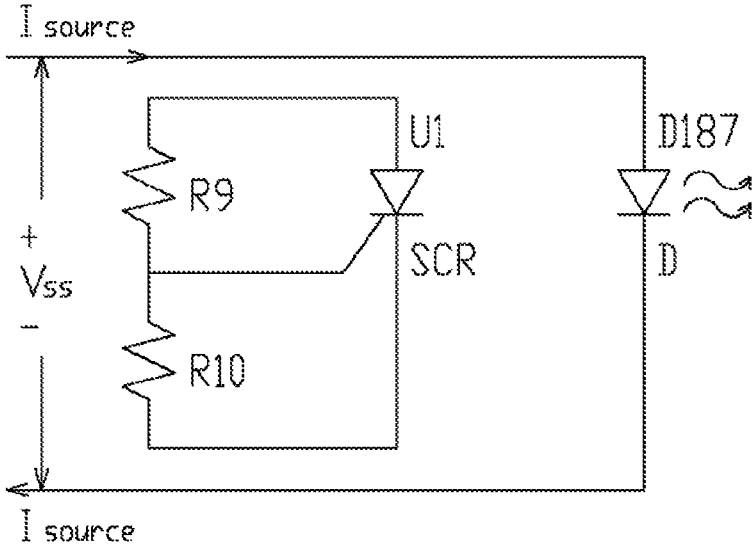

FIG. 11A shows a single semiconductor device known as an SCR connected in parallel with an LED according to another exemplary embodiment of the present invention.

Figure 11B:
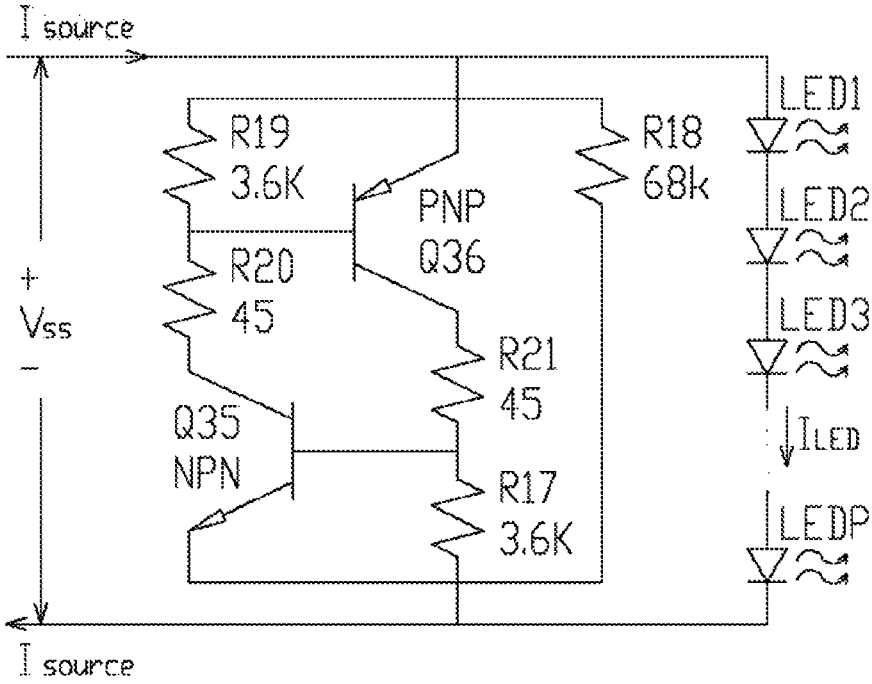

FIG. 11B is a transistorized circuit that functions similarly to FIG. 11A with the addition of the ability to modify trigger and sustain current through use of resistive components according to another exemplary embodiment of the present invention.

Figure 11C:
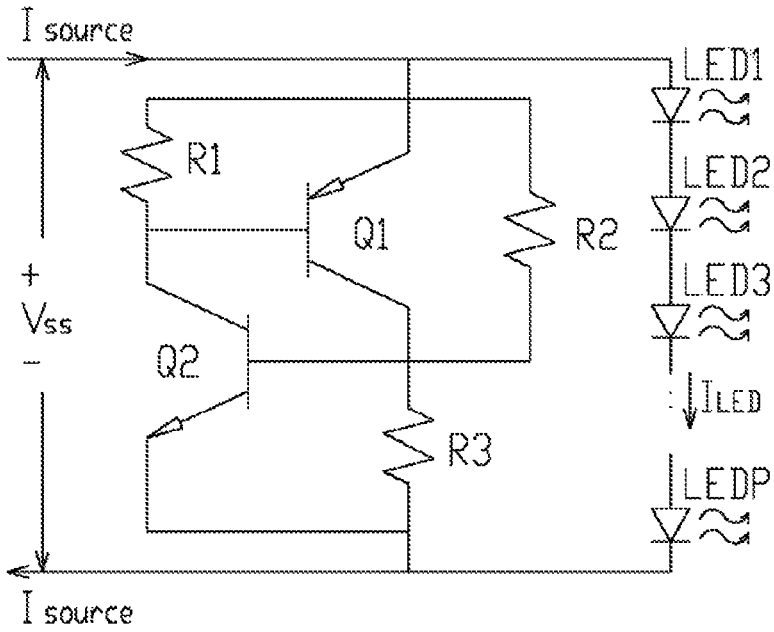

FIG. 11C shows a circuit similar to FIG. 11B without the series resistors according to another exemplary embodiment of the present invention.

Figure 11D:
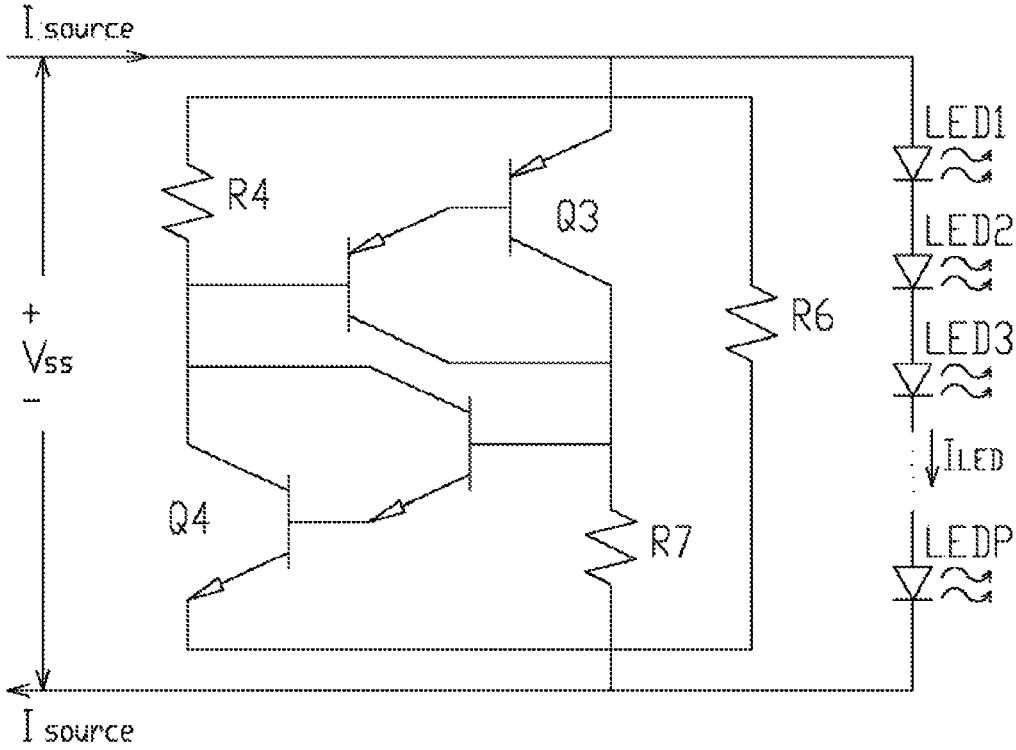

FIG. 11D shows a circuit similar to FIG. 11B with a Darlington transistor configuration which increases the transistor gain according to another exemplary embodiment of the present invention.

Figure 12:
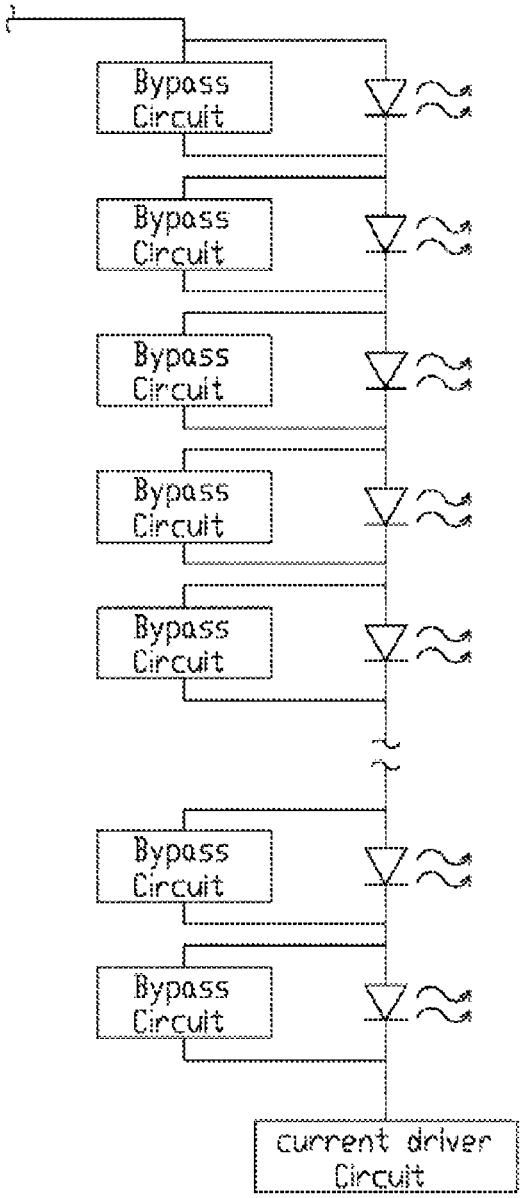

FIG. 12 shows an array of LEDs within a single circuit with bypass circuits included according to another exemplary embodiment of the present invention.

Figure 13:
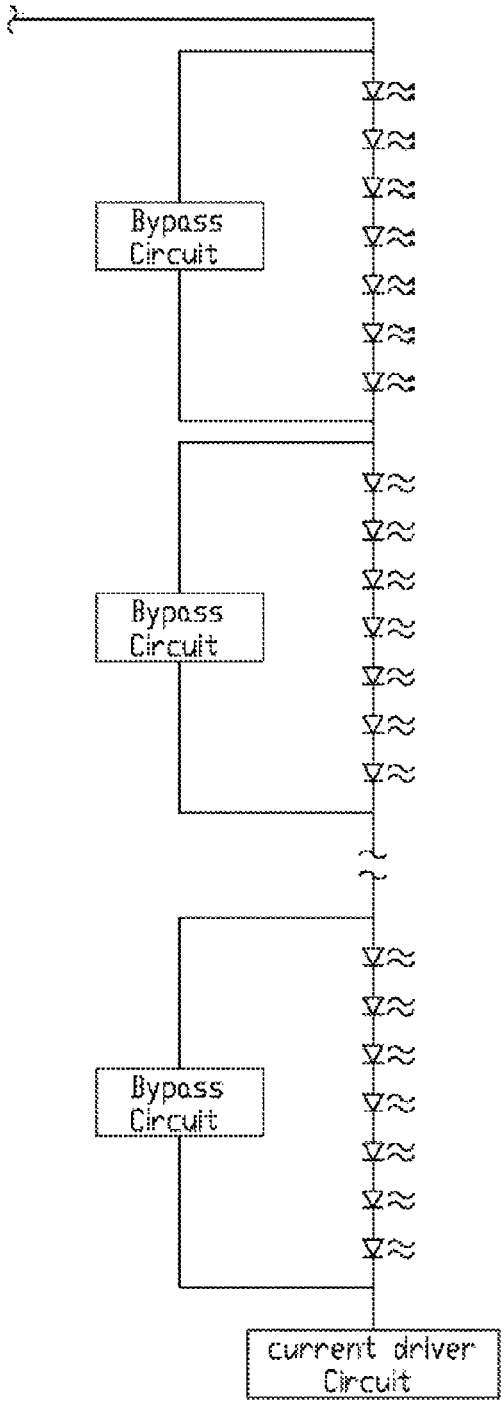

FIG. 13 shows an embodiment wherein the series connected LEDs can be broken into groups such that one circuit protects a number of LEDs according to another exemplary embodiment of the present invention.

Figure 14:
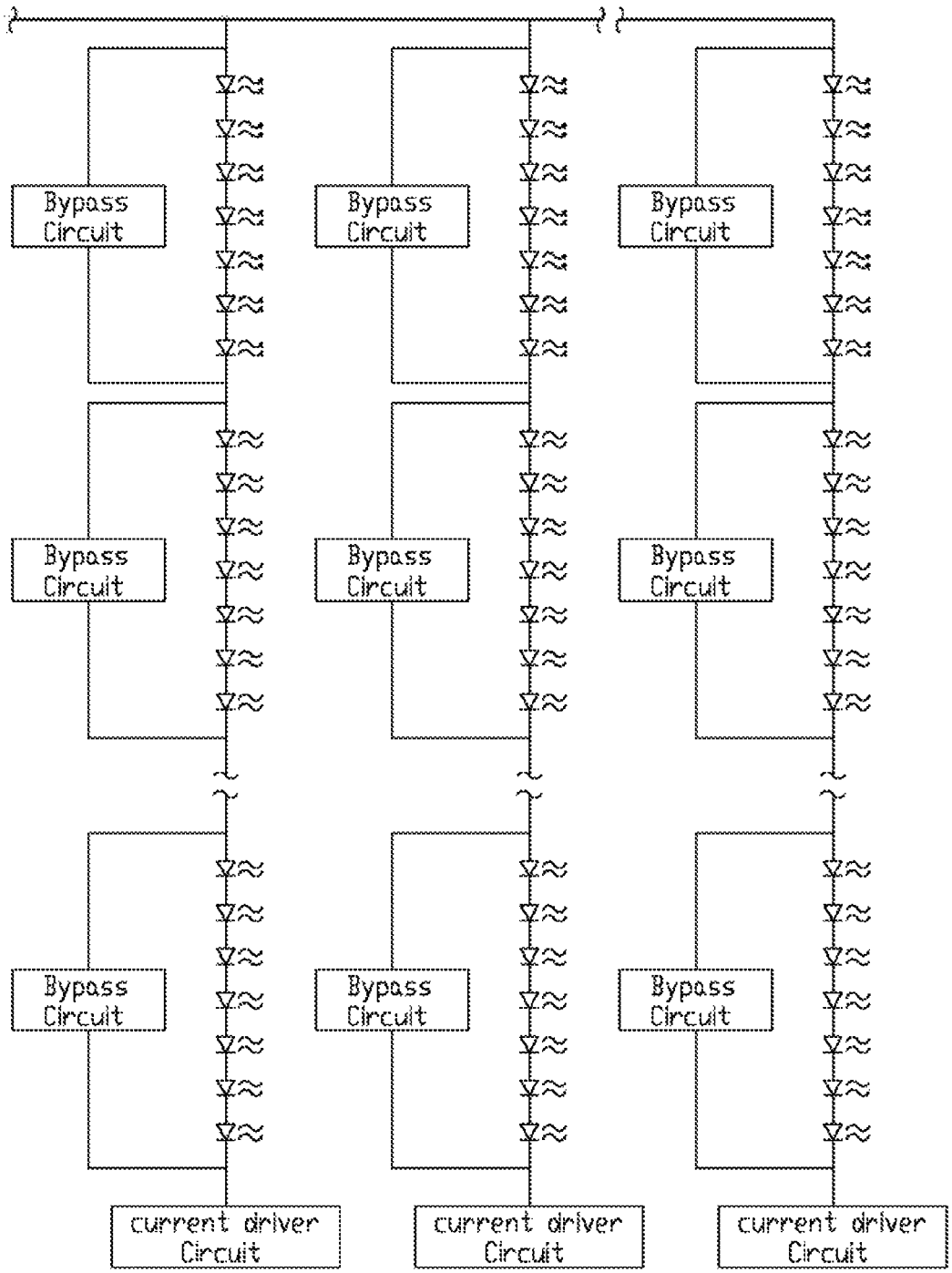

FIG. 14 shows an embodiment where several strings of LEDs are included in a single fixture or system of fixtures having OLPC (Open LED Protection Circuit) protection for each substring and a current driver for each substring according to another exemplary embodiment of the present invention.

Figure 15:
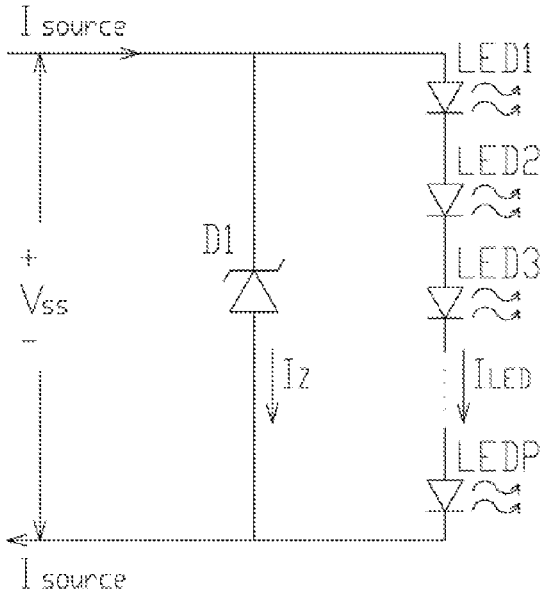
Figure 16A:
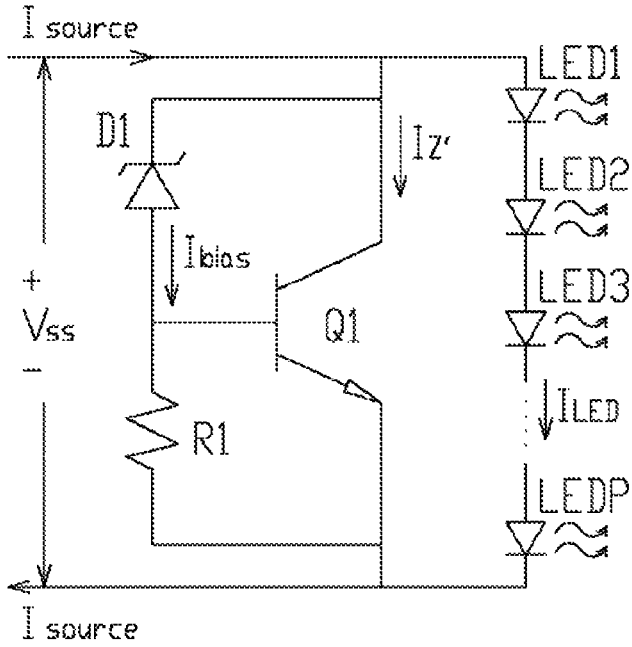
Figure 16B:
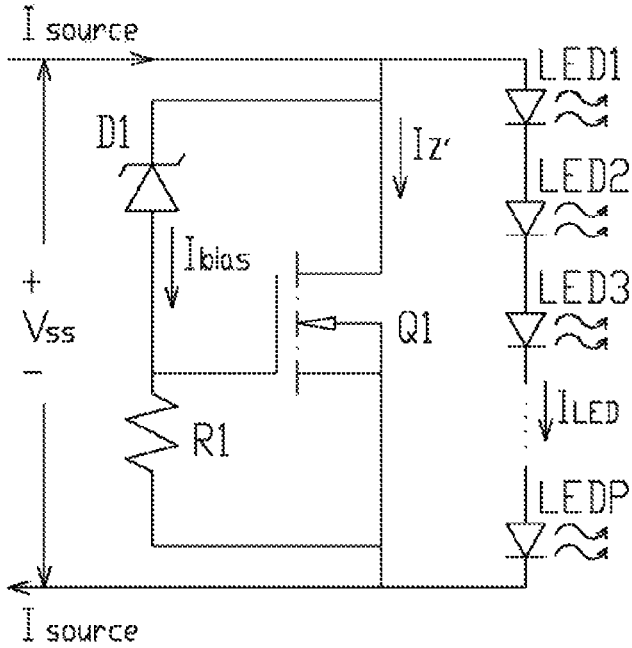
Figure 16C:
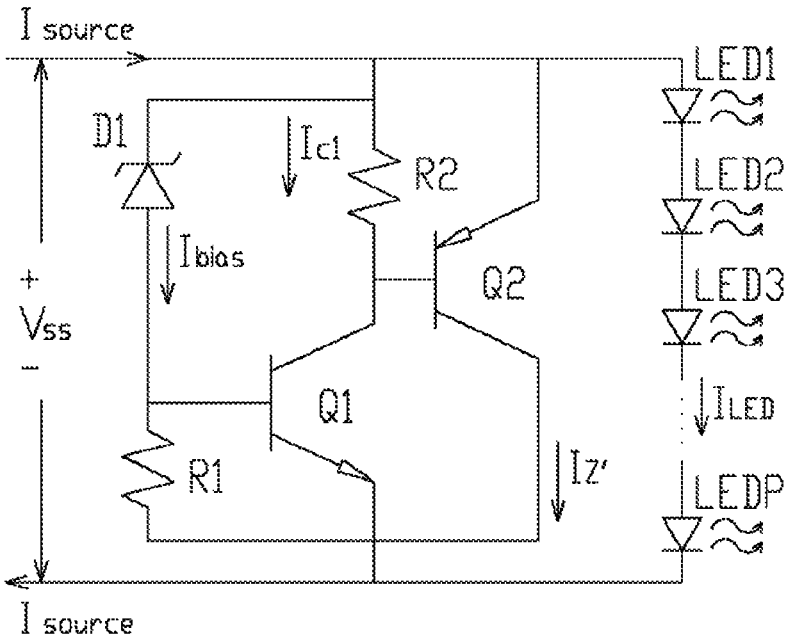
Figure 16D:
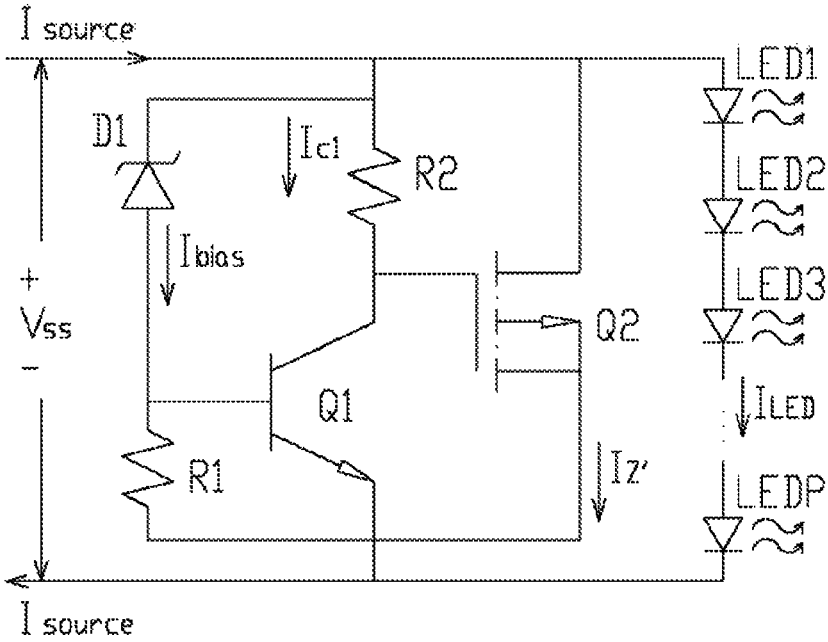
Figure 17A:
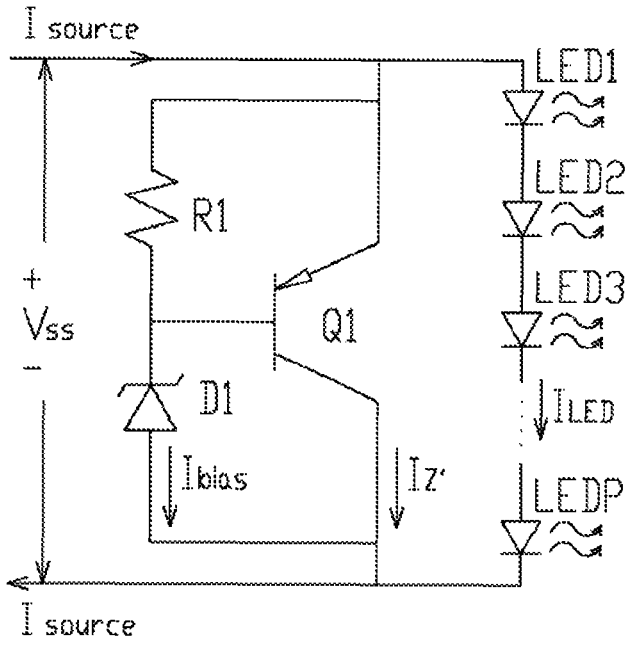
Figure 17B:
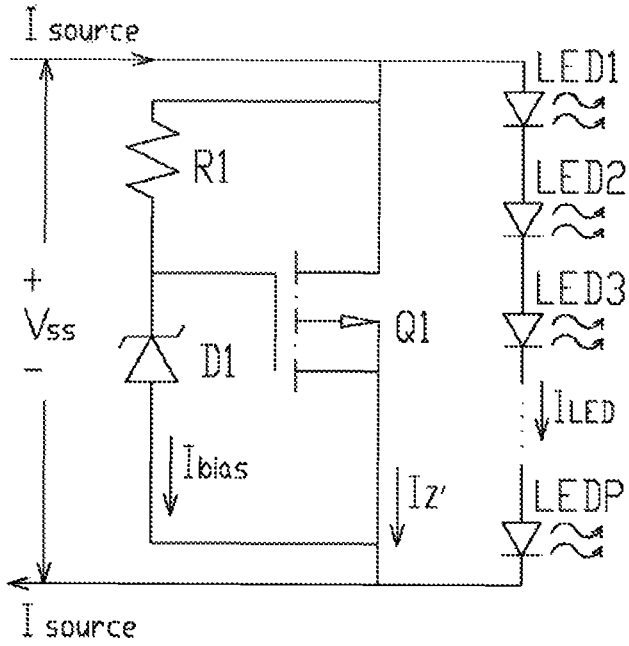
Figure 17C:
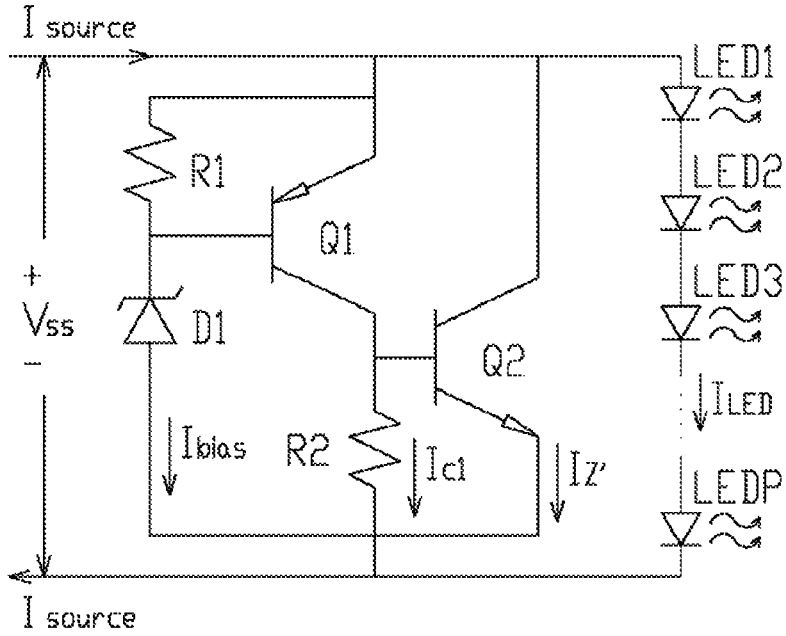
Figure 17D:
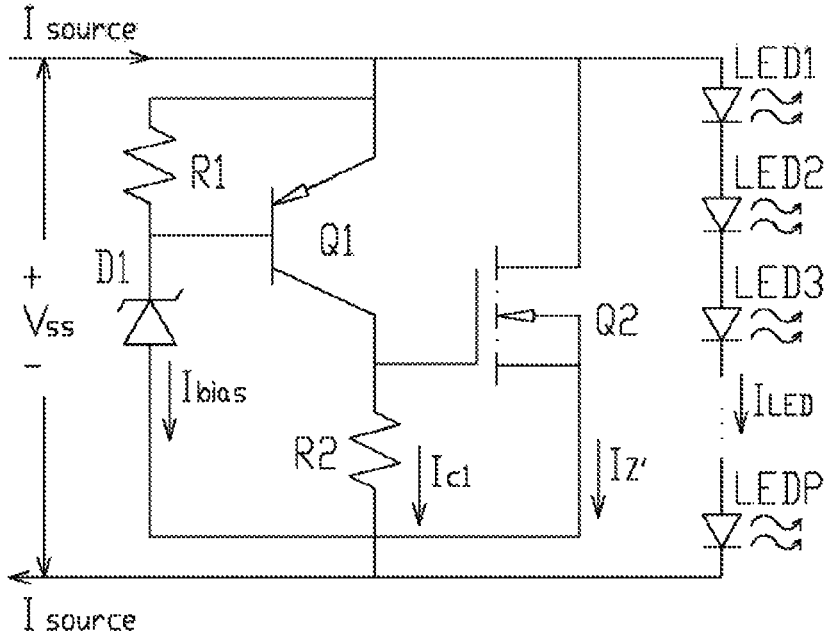

FIG. 15 shows alternative circuit configurations that can be used to provide OLPC operation according to another exemplary embodiment of the present invention.

FIGS. 16A-D show alternative circuit configurations that can be used to provide OLPC operation according to another exemplary embodiment of the present invention.

FIGS. 17A-D show an alternative circuit configuration that can be used to provide OLPC operation according to another exemplary embodiment of the present invention.

Figure 18:
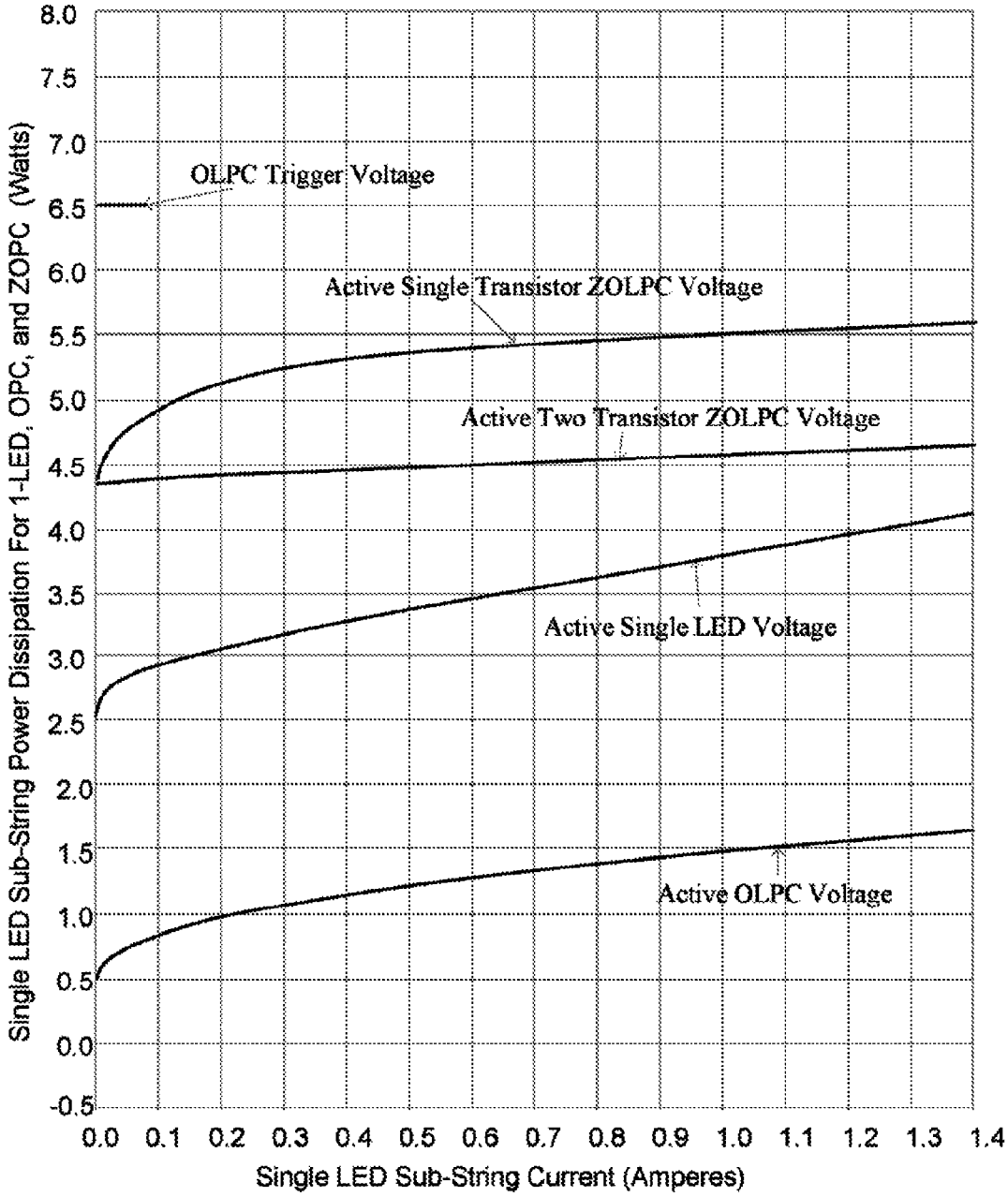

FIG. 18 shows a graph of the operating voltages versus current for an LED, OLPC, and a single transistor and two-transistor ZOLPC for a protected single LED sub-string.

Figure 19:
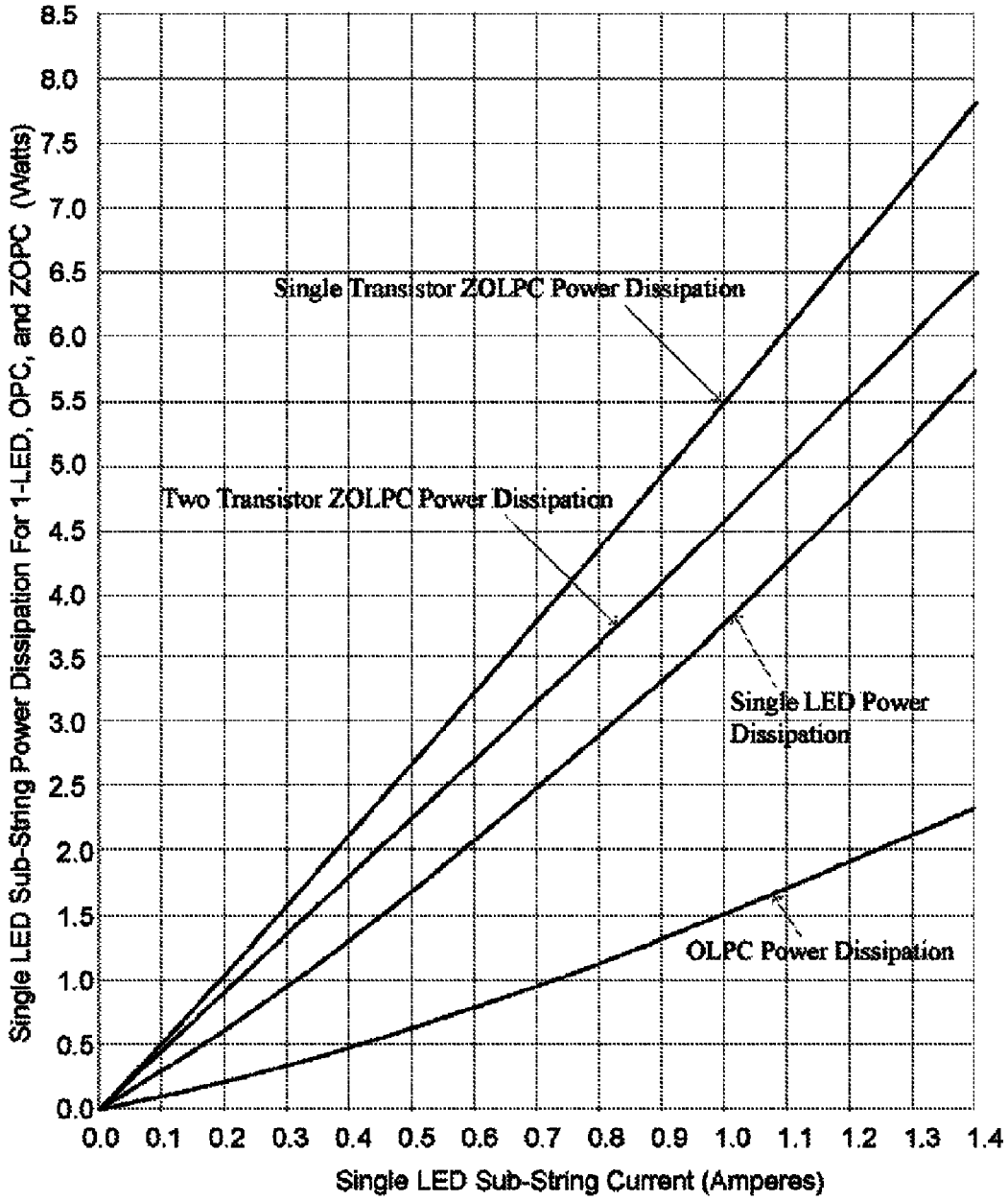

FIG. 19 shows a graph of the power dissipation of an LED, OLPC, and a single transistor and two-transistor ZOLPC for a protected single LED sub-string.

Figure 20:
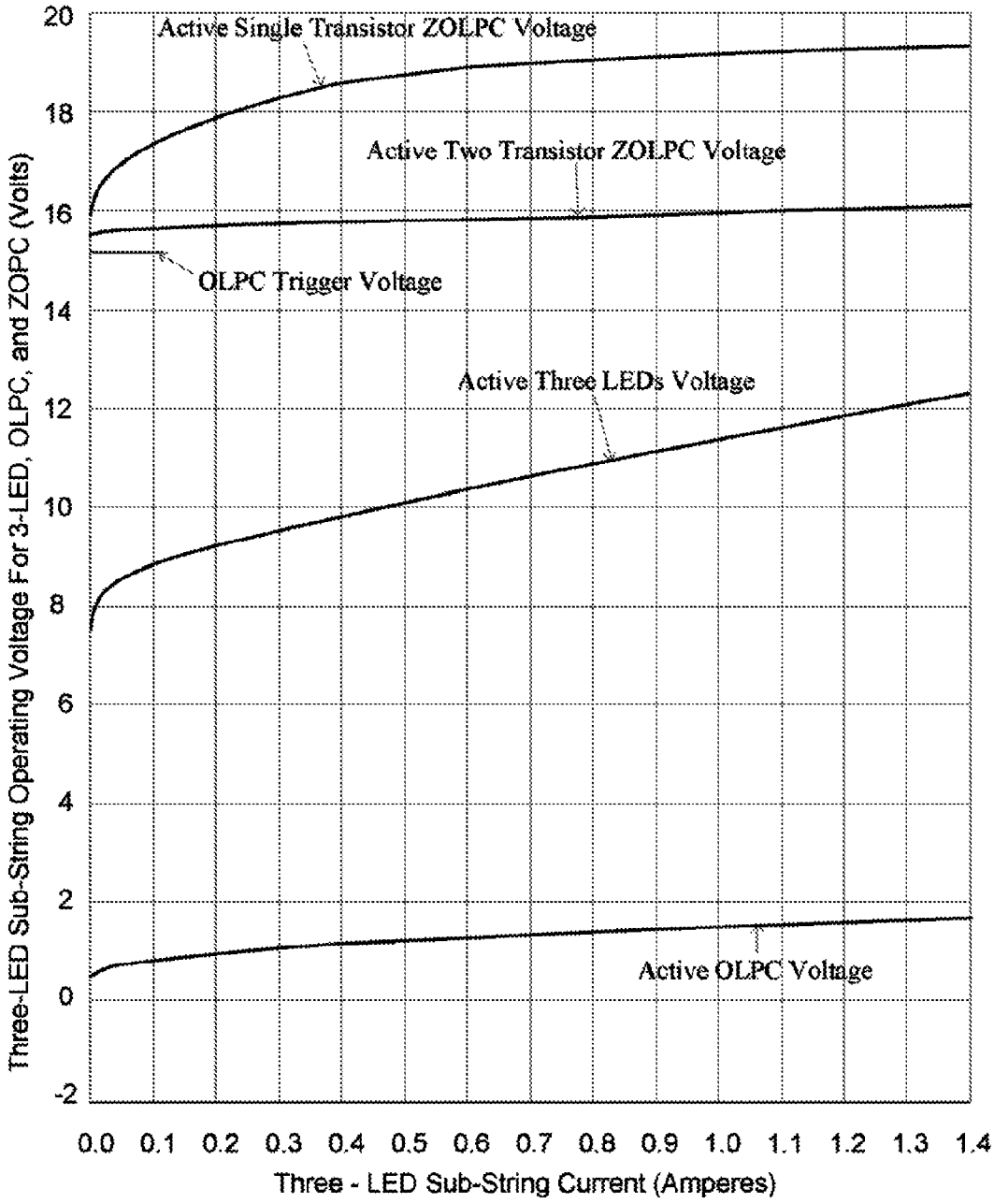

FIG. 20 shows a graph of operating voltage when a protected 3-LED sub-string is implemented.

Figure 21:
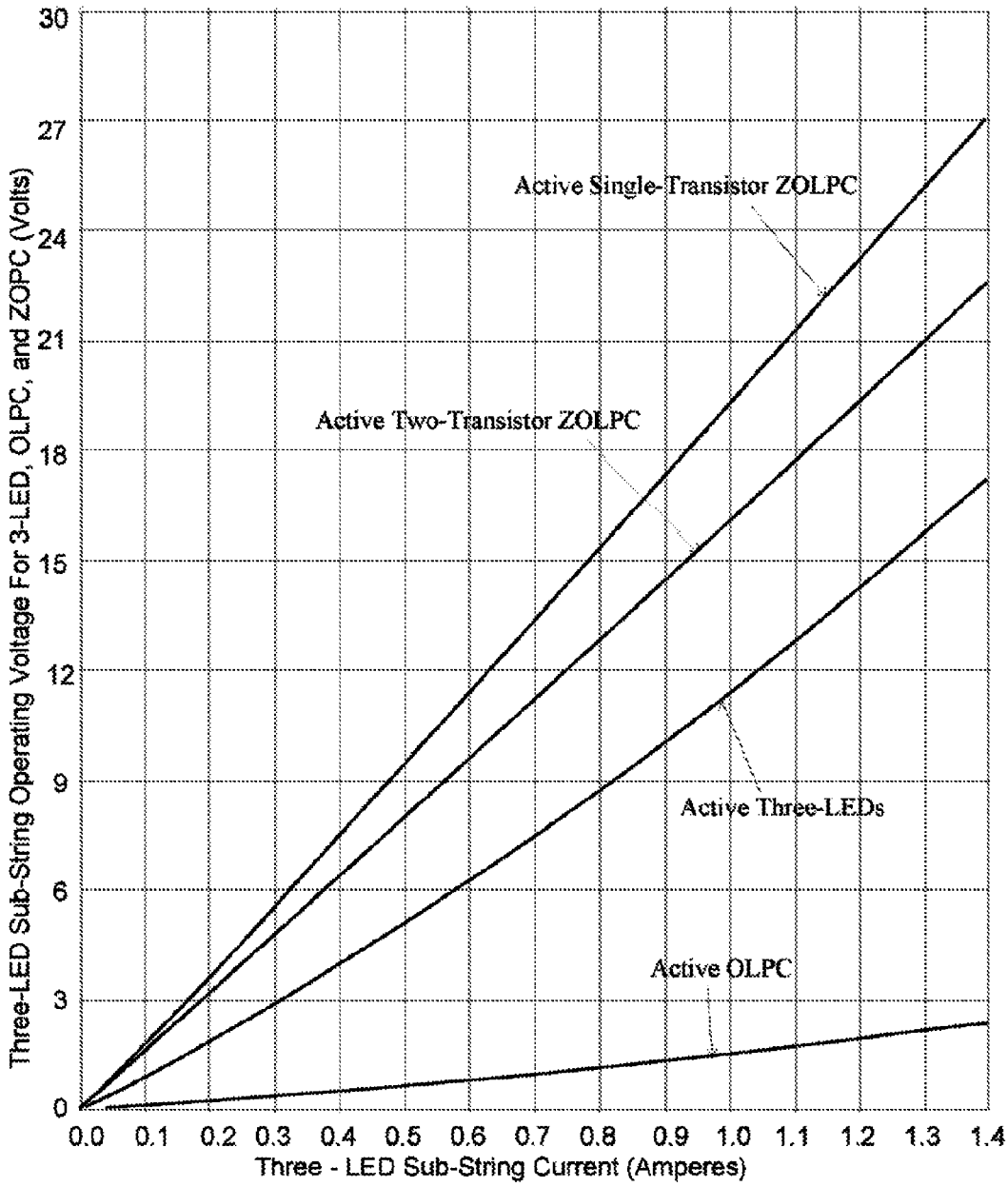

FIG. 21 shows a graph of power dissipation when a protected 3-LED sub-string is implemented.

Figure 22:
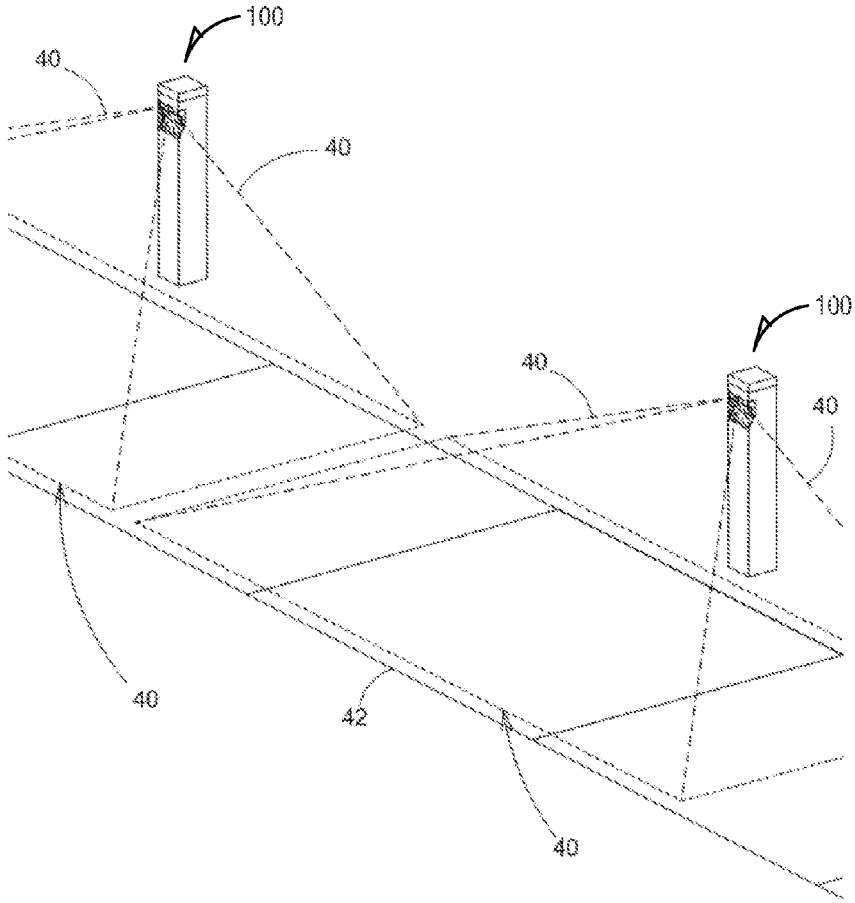

FIG. 22 illustrates a view of an embodiment similar to FIG. 13 wherein an array of LEDs is distributed over several fixtures according to another exemplary embodiment of the present invention.

Figure 23:
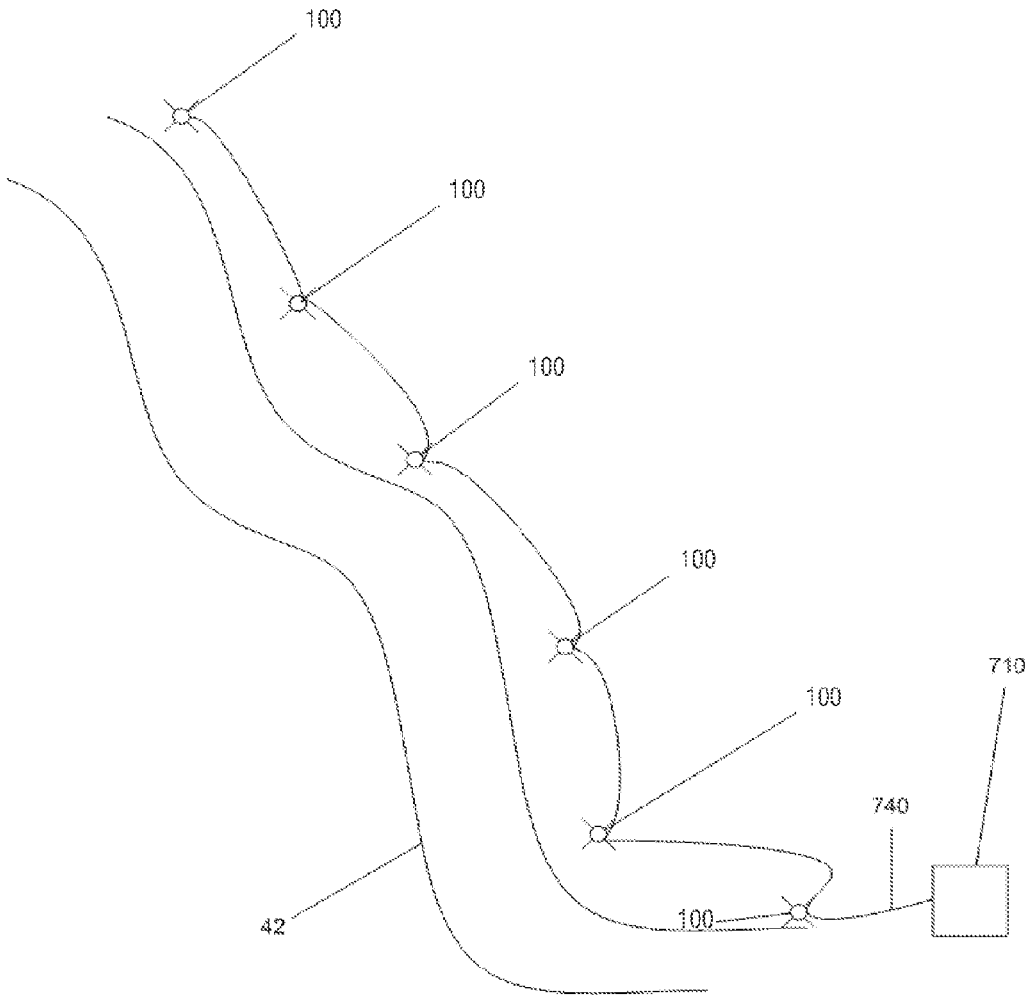

FIG. 23 shows a plan/schematic view of a similar installation as FIG. 22.

Figure 24:
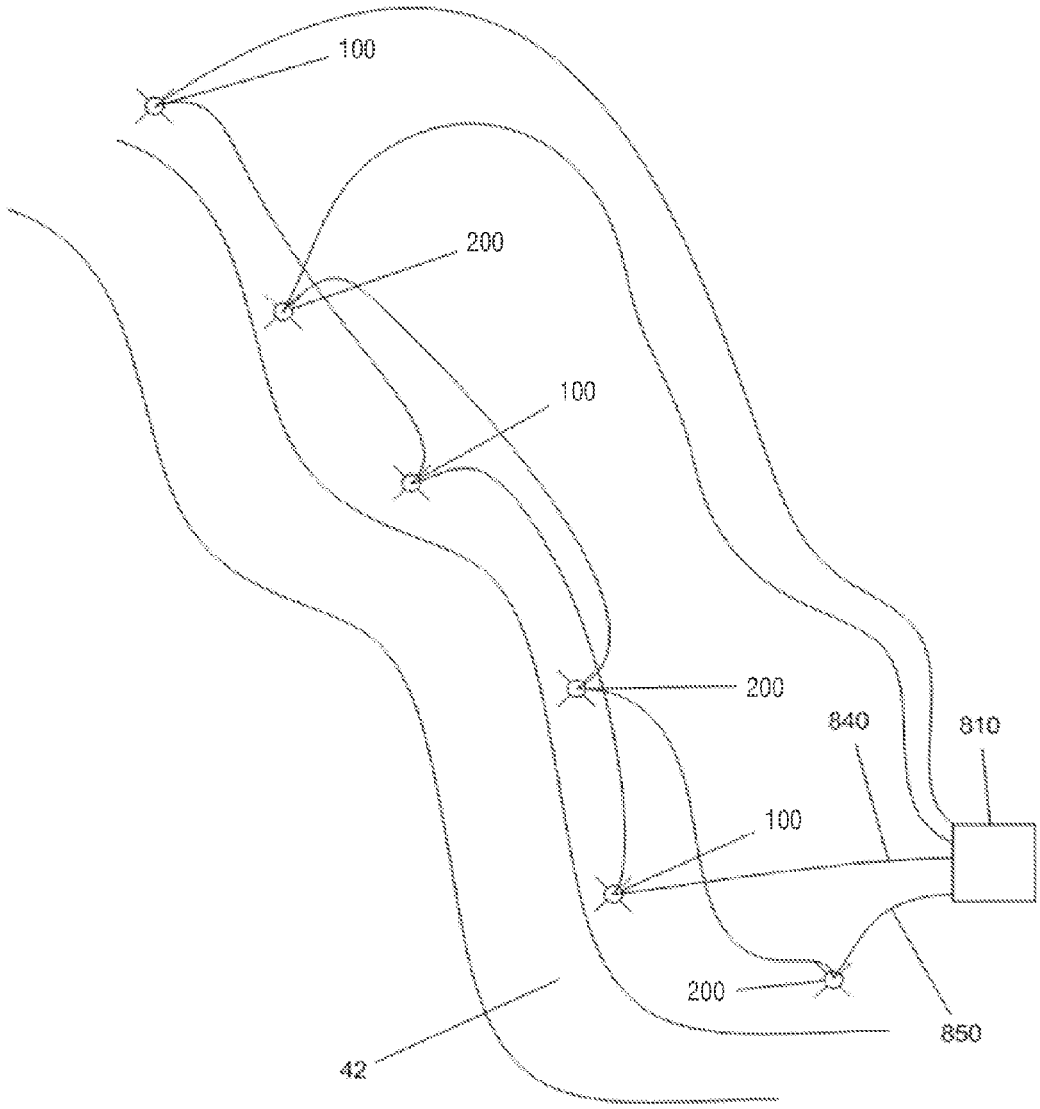

FIG. 24 shows a view of a similar installation as FIGS. 22 and 23 having more than one LED circuit according to another exemplary embodiment of the present invention.

IV. DETAILED DESCRIPTION OF EXEMPLARY EMBODIMENTS

A. Overview

To assist in a better understanding of the invention, examples of several exemplary forms it can take will now be described in detail. It is to be understood that these are but a few forms the invention could take. The invention could take many forms and embodiments. The scope of the invention is not limited by the few examples given herein. Also, variations and options obvious to those skilled in the art will be included within the scope of the invention.

B. Figures

From time to time in this description, reference will be made to the appended figures. Reference numbers or letters will be used to indicate certain parts or locations in the figures. The same reference numbers or letters will indicate the same or similar parts or locations throughout the figures unless otherwise indicated.

C. Application

Figure 1:
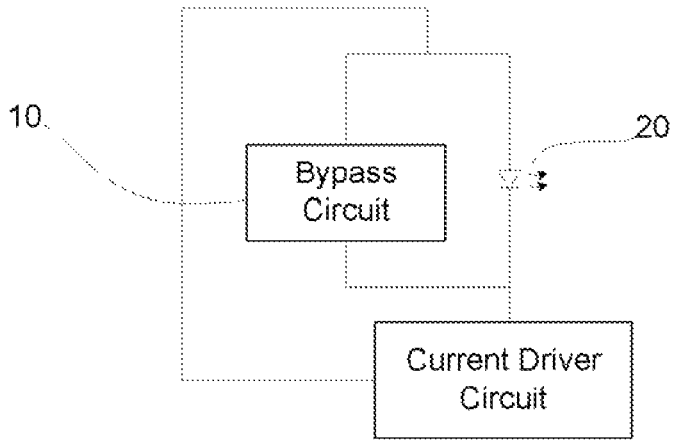

This invention is intended to provide a relatively inexpensive electronic circuit 10, FIG. 1, to be placed in parallel with a single LED 20 or with one or more strings of LEDs that will provide an alternate current path around the LED or string(s) of LEDs in response to an open LED failure. When the LED is operational, the alternate circuit path current is significantly less than the LED current. When an LED open failure occurs, the alternate circuit path passes 100% of the LED current and produces a voltage drop that may be less than the LED operating voltage. The circuit components could be adjusted or trimmed so that both the LED operating voltage and current could be maintained when an LED open failure occurs. Embodiments can include fixtures with a single string of LEDs such as illustrated in FIGS. 10B-C, 11B-D, 12 and 13. Other embodiments can include fixtures with more than one string of LEDs in parallel, which use an individual driving circuit or scheme for each parallel string, such as illustrated in FIG. 14. Still other embodiments can include individual fixtures that include one or more LEDs that are controlled in accordance with the principles described herein, but which may include individual LEDs or strings of LEDs which are physically separated from each other such as in FIG. 22-24. Still other embodiments may combine these elements in other ways.

D. Methods and Embodiments

Figure 3A:
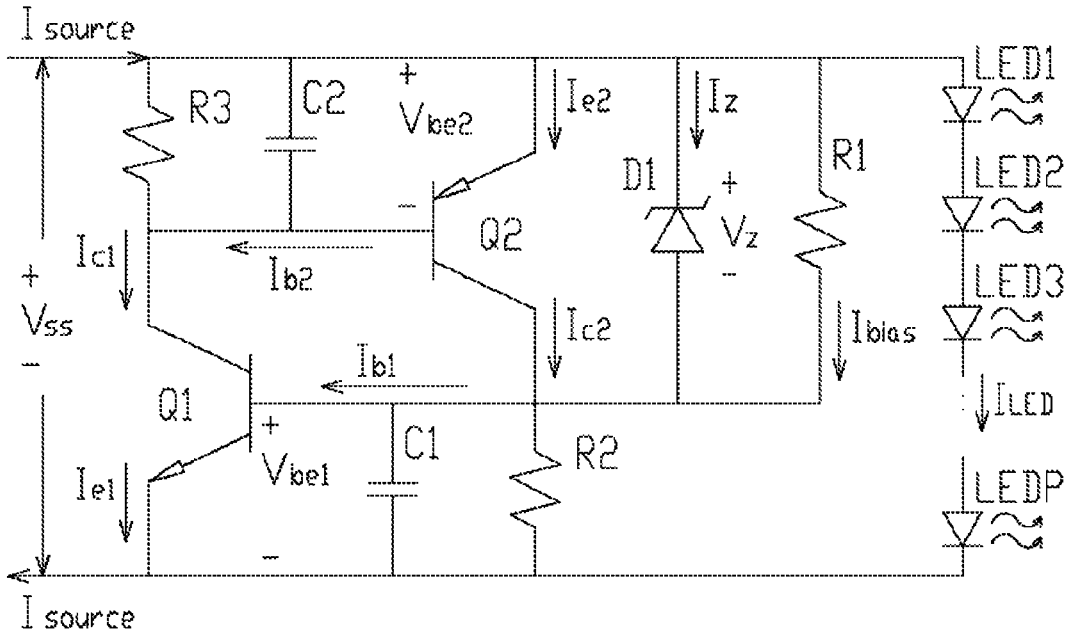
Figure 3B:
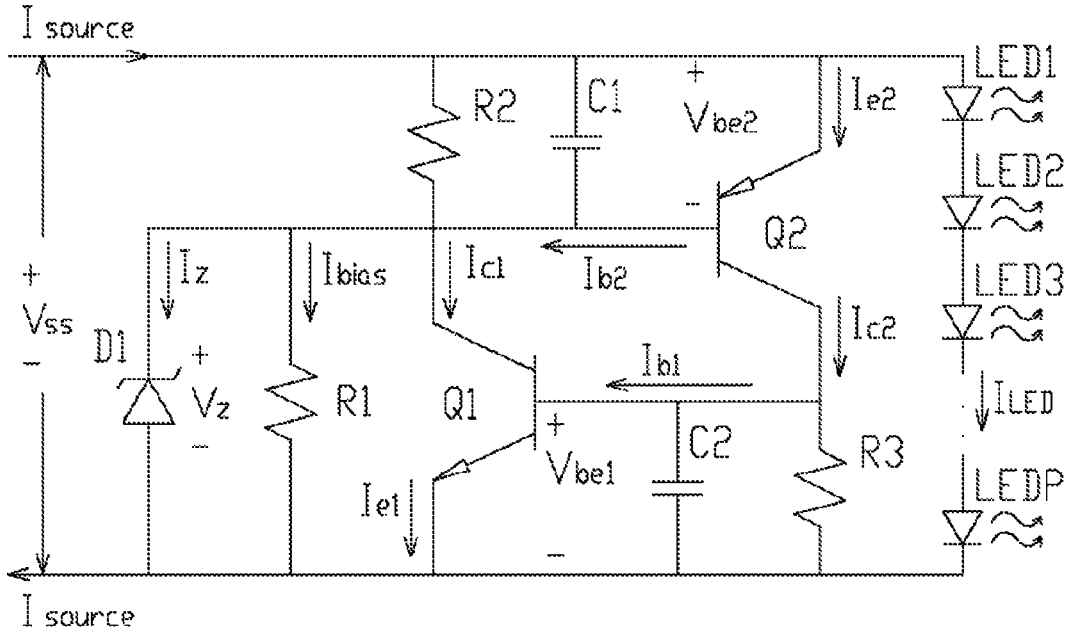

The circuit in FIG. 3A shows one way to build what is sometimes called herein an Open LED Protection Circuit (OLPC). The LEDs numbered LED1-LEDP, represent a sub-string of series connected LEDs in an array comprising a number of series connected sub-strings. The OLPC allows the current that would normally be conducted by the sub-string to have an alternate path available through, transistors $Q_1$ and $Q_2$, if an open circuit occurs in the sub-string of $LED_{1-P}$. Conduction of the current through $Q_1$ and $Q_2$ will permit the remaining series connection of similar sub-strings of LEDs to remain in operation. The OLPC comprises components Zener diode $D_1$, resistors $R_{1-3}$, capacitors $C_{1-2}$, and transistors $Q_{1-2}$. While the LEDs, $LED_{1-P}$, are operating normally, the OLPC will be inactive, conducting only small leakage and bias currents. If any of the LEDs, $LED_{1-P}$, fail open circuited, the OLPC will activate providing a current path around $LED_{1-P}$. Capacitors $C_1$ and $C_2$ filter transients to prevent false triggering of the protective circuit when the sub-string LEDs, $LED_{1-P}$, are functional.

During normal operation LEDs, $LED_{1-P}$, conduct the majority of the current $I_{source}$. The small reverse leakage current $I_{lZ}$, of Zener diode $D_1$, the small leakage currents, $I_{CE}$, of $Q_1$ and $Q_2$, and the small current $I_{bias}$ can be used to set the upper boundary for the value of $R_2$. The voltage value equal to $R_2$ multiplied by the sum of $(I_{bias}+I_{lZ}+I_{CE2})$, must be much less than the forward voltage $V_{be1}$, to prevent $Q_1$ from conducting during normal operation of the sub-string, $LED_{1-P}$. Thus, $R_2$ must be small enough to prevent $Q_1$ from turning on due to leakage currents.

Under an open circuit failure condition of the sub-string, the voltage $R_2I_{bias}$ or $R_2I_z$, must be greater than the forward voltage $V_{be1}$, by a sufficient amount to cause both $Q_1$ and $Q_2$ to turn on and conduct the current $I_{source}$. Once both $Q_1$ and $Q_2$ start conducting, the shunt circuit operation will latch itself on to conduct the total current $I_{source}$. Once the shunt circuit is latched on, $Q_1$ and $Q_2$ will continue to conduct $I_{source}$ until the magnitude of $I_{source}$ is reduced to a value such that the voltage, $\frac{1}{2}(R_2I_{source})$, is less than the forward voltage $V_{be1}$. The minimum value of the $I_{source}$ then sets lower boundary for $R_2$. Therefore, the voltage $\frac{1}{2}(R_2 I_{source})$, must be greater than $V_{be1}$, the turn-on voltage. The magnitude of $I_{source}$ may vary when linear dimming is applied to the system and the value of $R_2$ must be sufficient to maintain latched operation at the lowest dimming values of $I_{source}$.

The operation of the latch formed by $Q_1$ and $Q_2$ is explained as follows. $Q_1$ conducts collector current $I_{C1}$, when the magnitude of $R_2(I_{bias}+I_z)$ exceeds the junction voltage value of $V_{be1}$. $Q_2$ conducts collector current $I_{C2}$ when the magnitude of $R_3 I_{C1}$ exceeds the junction voltage value of $V_{be2}$. The voltage produced at $R_2$ provides positive feedback to the base of $Q_1$ to keep $Q_1$ conducting; creating a latching circuit comprising transistors $Q_1$ and $Q_2$. When the latch circuit turns on, $Q_1$ and $Q_2$ will be in saturation and the voltage magnitude that appears across the OLPC active voltage $V_{latch}$, will have a magnitude of $V_{be1}+V_{be2}$, and the sum of each of the collector currents, $I_{c1}+I_{c2}$, will equal $I_{source}$. The latching operation will cease when the product of $R_2 I_{source}/2$ becomes less than $V_{be1}$. Then the positive feedback is no longer sufficient to sustain the latched operation of $Q_1$ and $Q_2$. The current gain of transistors $Q_1$ and $Q_2$, the magnitude of the resistors $R_1$ and $R_2$, and the values of $V_{be1}$ and $V_{be2}$, will determine the minimum value required for the current $I_{source}$, which will maintain the latch condition. The values of $V_{be1}$, $V_{be2}$, $D_1$, $R_1$, and $R_2$ also determine the conditions necessary to turn-on (trigger) the latch circuit in the event an open circuit of any of the LEDs, $LED_{1-P}$, in the sub-string occurs.

The latch is set, or triggered, whenever any one or all of the sub-string LEDs become open circuited. The trigger must be present under three operating conditions: first, latch triggering must occur if the LED becomes open circuited while the LED circuit has power applied. Second, the trigger must occur if the LED is already open circuited and power is applied. Third, the latch must release and then re-trigger when current is pulsed while using Pulse Width Modulation (PWM) dimming or other dimming methods using variably switched current while an open-circuited LED sub-string exists. Furthermore, the trigger must be able to latch $Q_1$ and $Q_2$ at any value for $I_{source}$ between a specified minimum and maximum value, for all the three conditions. The latch trigger voltage must not occur in any one of the three operating conditions if there are no open-circuited LEDs in the sub-circuit.

Figure 5A:
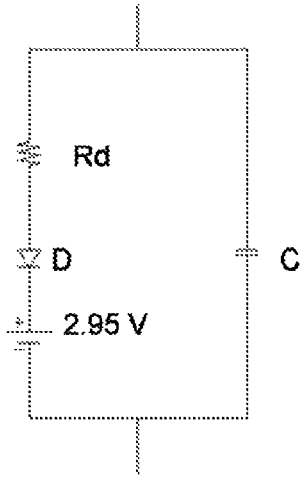
Figure 5B:
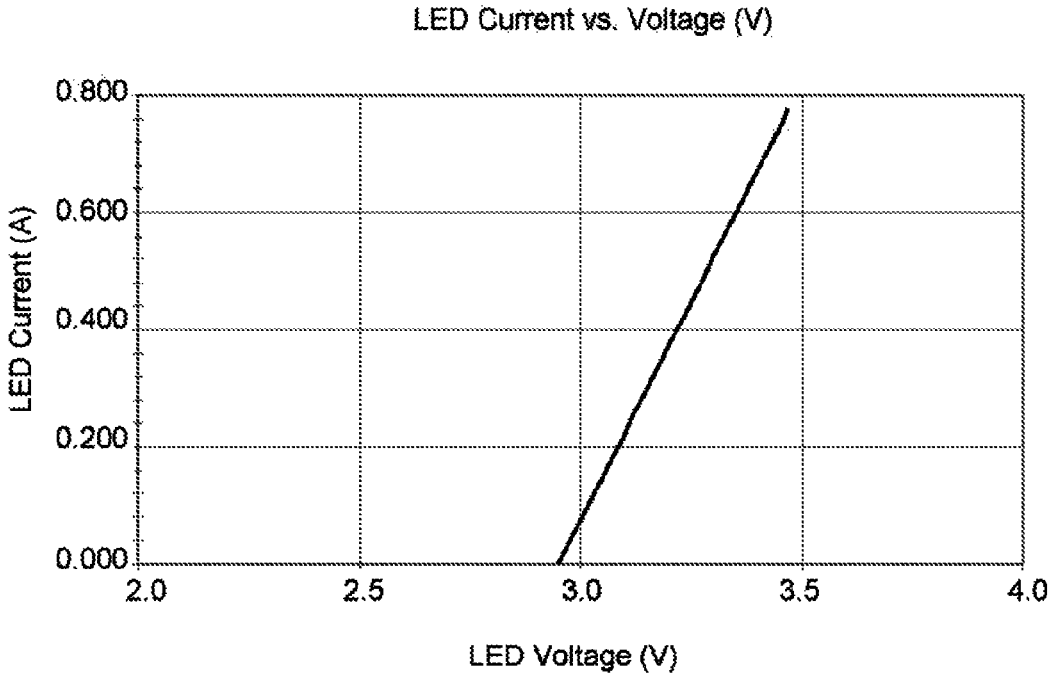

The operation of the latch trigger assumes the following two power source conditions: First, the LED current is set and controlled by the LED power source. Second, the unloaded output voltage of the power source is greater than the forward voltage (ON voltage) of the LED plus the trigger voltage needed over the system operating temperature range. The circuit shown in FIG. 5A is a piece-wise model of a typical high brightness LED used to represent the current versus voltage operation of the non-linear LED. Note that the diode D used in this model is an ideal diode, which allows current to flow in one direction and blocks current flow in the other direction but does not have any offset voltage or any forward resistance to current flow. The battery is used to represent the offset voltage needed before conduction begins and the resistance models the low dynamic resistance of the LED when it is conducting. The capacitor models the junction capacitance along with the LED stray package capacitance. This capacitance becomes significant when transients exist. FIG. 5B shows the electrical DC current voltage relationship of the piece-wise model of FIG. 5A.

The typical high brightness LED electrical characteristics modeled in FIGS. 5A-B shows that the voltage $V_{LED}$, ranges from approximately 3 to 3.5 volts depending on the value of the LED operating current. Also in FIG. 3A, it is well known that the value of $V_{be1}$ and $V_{be2}$ for full conduction of transistors $Q_1$ and $Q_2$ is approximately 0.7 Volts at 25° C. In FIG. 3A, components $R_1$ and $R_2$ provide a voltage divider across the LED sub-string $LED_{1-P}$, and produce a voltage $V_{be1}$ that is less than 0.6 volts when the LED is operating properly. The components comprising Zener diode $D_1$ and resistor $R_2$, provide a trigger voltage greater than or equal to 0.7 volts when the LED is open circuited. The use of resistor $R_1$, Zener diode $D_1$, or both $R_1$ and $D_1$, is optional in the circuit, as shown in the circuits of FIGS. 2A-4B. The primary purpose of $R_1$ and/or $D_1$ is to establish the trigger voltage for the latch when an open circuit is present in the LED sub-string. Because the dynamic resistance of the Zener diode is much less than the value of $R_1$, using the Zener diode will produce a much smaller trigger voltage than would be present with using $R_1$. However, the Zener diode voltage varies with temperature more dramatically than does the resistance of $R_1$. The choice of using $R_1$, $D_1$, or both $R_1$ and $D_1$, will depend on the application requirements.

Once transistors $Q_1$ and $Q_2$ are triggered on, the voltage across the sub-string will drop to $V_{latch}$ which is approximately 1.4 Volts. Once conduction starts, $Q_2$ will hold the voltage $V_{be1}$ to a value greater than 0.7 volts. For the circuit of FIG. 3A, the sub-string voltage is $V_{latch}$ during conduction which will be less than the Zener diode conduction voltage, so $D_1$ will not conduct current. Also, because the magnitude of $V_{latch}$ is small, the voltage divider comprising $R_1$ and $R_2$ will have a negligible effect on the voltage $V_{be1}$.

The trigger voltage that initiates conduction of $Q_1$ and $Q_2$ when the LED is open circuited is generated automatically by the application of the LED power source only if the power source open circuit voltage is sufficiently greater than the LED operating voltage. When any open circuit exists, the voltage developed across the open circuited sub-string will rise toward the power source unloaded voltage until the sub-string voltage equals $V_{trig}$, the voltage necessary to turn on $Q_1$ and $Q_2$. The voltage rise is not instantaneous because of the capacitance of the LED as represented in FIG. 5A, and other stray circuit capacitance. The circuit components, Zener diode D1 and resistors $R_1$, $R_2$, will use this rise in voltage across the open sub-string to cause the voltage $V_{be1}$ to rise until it exceeds 0.7 volts, thus turning on $Q_1$ and $Q_2$. Once $Q_1$ and $Q_2$ conduct, the positive feedback from $Q_2$ will latch the circuit on and the voltage will drop from the $V_{trig}$ value it attained down to the value $V_{latch}$ of the latched voltages of $Q_1$ and $Q_2$ of approximately 1.4 Volts, thereby turning off conduction of Zener diode $D_1$.

The preceding operational discussion indicates the necessity of the two conditions imposed on the LED driver or power source in these embodiments: i.e., the power source must be a current controlled source capable of sufficient voltage to attain trigger voltage $V_{trig}$ for the number of OLPCs in operation. When a single LED sub-string in the array is open, having sufficient voltage will not be a problem. However, if a number of LED sub-strings fail open circuited, the voltage that appears across each open circuit can only attain the power source open circuit voltage divided by the number q, of open LED sub-string circuits. In such a situation, the open circuit power source voltage must exceed q times $V_{trig}$. Consequently, there is a limit to the number q of open LED sub-strings that can be accommodated by the power source. The number of open circuited LED sub-strings in a given series string which can be bypassed by OLPCs is determined by the ratio of the power source open circuit Voltage (unloaded voltage) and the magnitude of $V_{trig}$.

The equations describing the operation of the LED Shunt circuit can be determined by referring to FIG. 3A and by applying the operation principles described above. The triggering characteristics are dependent on the high brightness LED forward voltage $V_{LED}$, as well as the turn on or forward voltage $V_{be}$ of the transistors $Q_1$, $Q_2$, and the reverse voltage of Zener diode $D_1$. These three voltages are temperature dependent, and each device has its own magnitude of temperature coefficient. The transistors $Q_1$ and $Q_2$, and the LEDs, $LED_{1-P}$, all have negative temperature coefficients. The Zener diode $D_1$, has a temperature coefficient which depends on the Zener voltage magnitude and which may be either negative or positive. In lighting applications that include outdoor environments, it is necessary to consider the extremes of the ambient temperatures as well as the operating device junction temperatures.

FIGS. 2A-4B illustrate several alternative circuits. The differences in the operation of the circuits between the 'A' and 'B' versions (i.e. FIG. 2A vs. 2B, FIG. 3A vs. 3B, and FIGS. 4A vs. 4B) only involve the voltage reference point of $V_{e1}$ or $V_{e2}$ in the equations and the change of references of $Q_1$ to $Q_2$. The performance and operation are described by the same equations as presented in the following analysis. The equations include the temperature effects needed to design and describe the operation for the OLPC configuration shown in FIG. 3A. The different options using $D_1$, $R_1$, or both $D_1$ and $R_1$ will be included when needed.

The variables used in the equations are defined as follows:

$V_{SS}$=the voltage across an LED sub-string=p times VLED.

$V_{trig}$=the $V_{SS}$ open circuit voltage at which $Q_1$ turns on $V_{thL}$=the threshold voltage of the LED or the voltage where current conduction through the LED starts at the temperature of $T_{REF}$. It is the same as the battery voltage shown in FIG. 5A.

$V_{tcL}$=the LED voltage temperature coefficient.

$V_{Lmax}$=the maximum LED sub-string forward voltage at rated current.

$V_{trig}$=the voltage across the LED sub-string necessary to cause $Q_1$ and $Q_2$ to turn on.

$V_{beth}$=the transistor base-emitter cut-on voltage at junction temperature of $T_{REF}$.

$V_{Zth}$=the cut-on reverse voltage of the Zener diode at junction temperature of $T_{REF}$.

$V_z$=the Zener diode reverse voltage.

$V_{beon}$=the transistor base-emitter voltage at full conduction at junction temperature of $T_{REF}$.

$V_{Ton}$=the transistor base-emitter voltage at full conduction as a function of Temperature.

$V_{be1}=V_{be2}=V_{be}$=the base-emitter voltage of $Q_1$ and $Q_2$.

$V_{Toff}$=the voltage at $V_{be}$ to keep $Q_1$ or $Q_2$ from turning on.

$V_{tcT}$=the transistor $V_{be}$ voltage temperature coefficient.

$V_{tcZ}$=the temperature coefficient of the Zener diode reverse voltage.

$V_{latch}$=the latched voltage of $Q_1$ and $Q_2$ when the OLPC is activated.

$I_{bias}$=the current through $R_1$ and $R_2$.

$I_{CE}$=the DC leakage current of $Q_1$ or $Q_2$.

$I_{lz}$=the Zener diode leakage current.

$I_z$=the forward current magnitude of the Zener diode $I_s$=the source current from the power source or LED Driver.

$I_{b1}$=the base current for transistor $Q_1$ needed to initiate the $Q_1$ and $Q_2$ latch.

$R_d$=the LED dynamic resistance.

$R_z$=the reverse voltage Zener diode "ON" dynamic resistance.

$R_{Lj-c}$=thermal resistance for LED junction-to-case.

$R_{Zj-c}$=thermal resistance for Zener diode junction-to-case.

$R_{Tj-c}$=thermal resistance for transistor junction-to-case.

$R_{c-a}$=thermal resistance of the array heat sink case to ambient.

k=ratio of $R_1/R_2$.

m=total integer number of LEDs connected in series and mounted on an array heat sink.

n=total integer number of LED sub-strings in an array.

p=integer number of series connected LEDs in a sub-string.

q=integer number of LED sub-strings that have failed open.

$T_{jL}$=LED junction temperature in ° C.

$T_{jT}$=transistor junction temperature in ° C.

$T_C$=temperature of the Case or Heat Sink in ° C.

$T_A$=ambient temperature in ° C.

$T_{REF}$=reference temperature of 25° C.

$T_{jZ}$=the temperature of the Zener diode junction in ° C.

Analysis for Holding $Q_1$ OFF With an LED:

From FIGS. 2A-B and 3A-B, when the LED is conducting, the following conditions apply. The equations are generalized to account for some number q of protected open LED sub-strings to exist on the array fixture containing a total number m of series connected LEDs.

$$0 \leqq pq \leqq m;\ \text{p, q and n are integers satisfying } 1 \leqq p \leqq m/n; \tag{1}$$

$$I_s = I_{bias} + I_{LED} + I_{lz} + I_{CE} \tag{2}$$

Figure 2B:
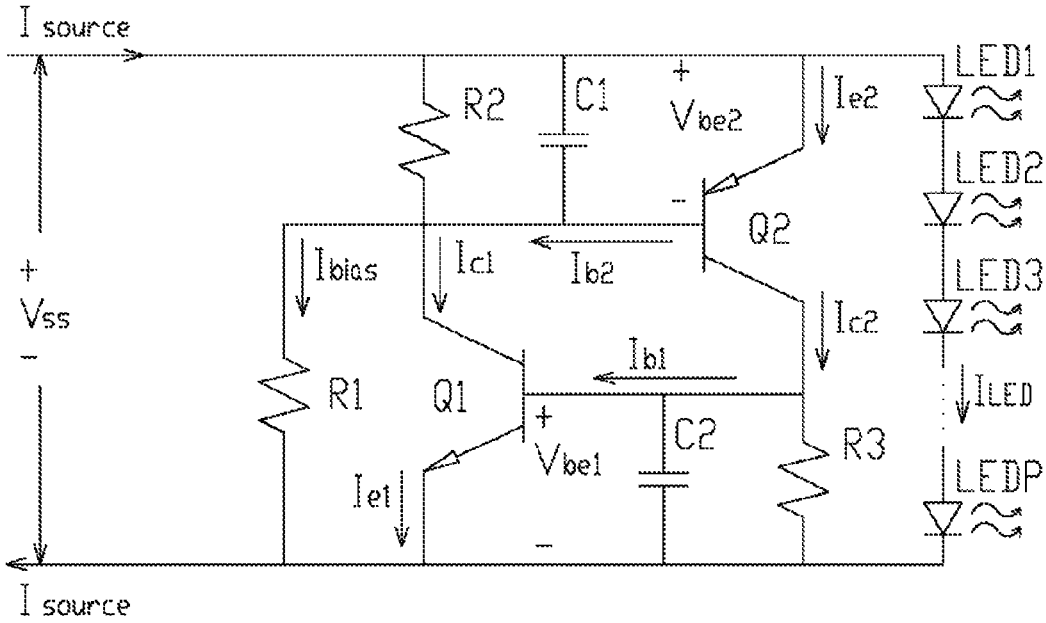
Figure 4A:
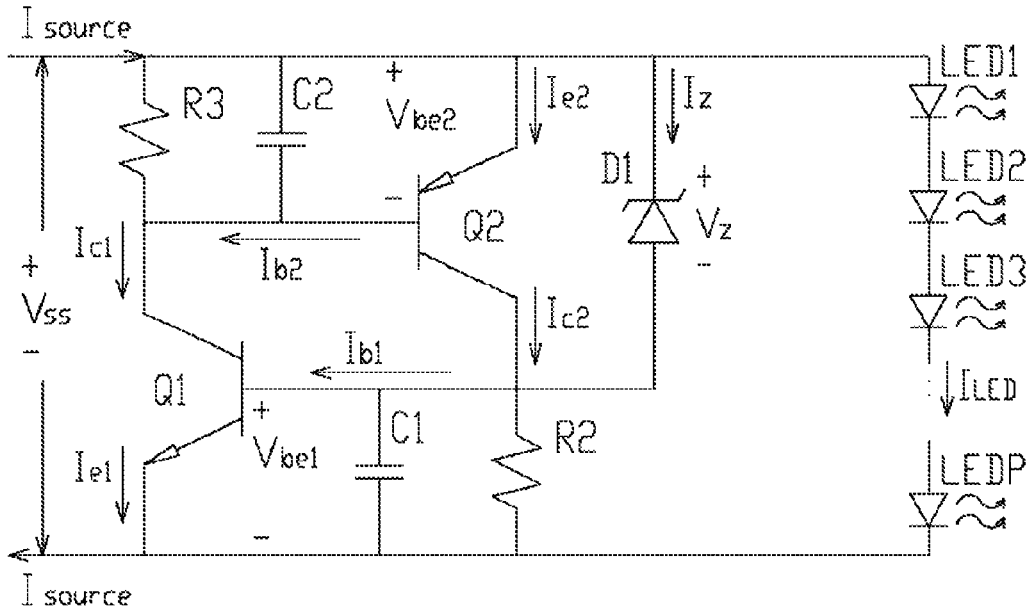
Figure 4B:
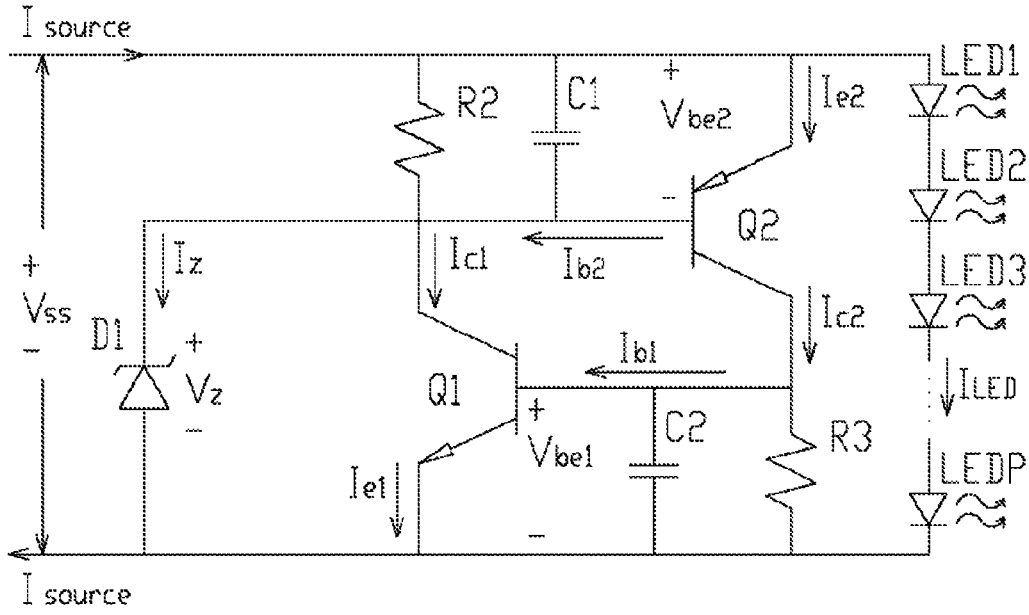

For FIGS. 2A-B, $I_{lz}$=0, For FIGS. 4A-B, $I_{bias}$=0.

$$I_{b1} = I_{b2} = 0 \tag{3}$$

$$V_{LED} = V_{thL} + R_d I_{LED} + V_{tcL}(T_{jL} - T_{REF}) \tag{4}$$

$$V_{SS} = pV_{LED} = p[V_{thL} + R_d I_{LED} + V_{tcL}(T_{jL} - T_A)] \tag{5}$$

$$T_{jL} = [R_{Lj-c} + (m-pq)R_{c-a}]V_{LED}I_{LED} + 2qR_{c-a}V_{Ton}I_{LED} + T_A \tag{6}$$

$$V_{Ton} = V_{beon} + V_{tcT}(T_{jT} - T_{REF}) \tag{7}$$

$$T_{jT} = [R_{Tj-c} + 2qR_{c-a}]V_{Ton}I_{LED} + (m-pq)R_{c-a}V_{LED}I_{LED} + T_A \tag{8}$$

Combining equations (3), (4), (5), (6), (7), and (8) leads to the relationship $V_{Ton}$ and LED sub-string voltage. $V_{SS}$ temperature relationship given below.

$$V_{SS} = p\left\{\frac{V_{thL} + R_d I_{LED} + V_{tcL}(2qR_{c-a}V_{Ton}I_{LED} + T_A - T_{REF})}{1 - [R_{Lj-c} + (m-pq)R_{c-a}]V_{tcL}I_{LED}}\right\} \tag{9}$$

$$V_{Ton} = \frac{V_{beon} + V_{tcT}[(m-pq)R_{c-a}V_{LED}I_{LED} + T_A - T_{REF}]}{1(R_{Tj-c} + 2qR_{c-a})V_{tcT}I_{LED}}\Bigg\} \tag{10}$$

$$V_{LED} = \frac{V_{thL} + R_d I_{LED} + V_{tcL}(2qR_{c-a}V_{Ton}I_{LED} + T_A - T_{REF})}{1 - (R_{Lj-c} + (m-pq)R_{c-a})V_{tcL}I_{LED}} \tag{11}$$

While the LED is operating normally, the voltage divider formed by resistors $R_1$ and $R_2$ (and/or the Zener diode $D_1$ leakage current) must not allow transistor $Q_1$ to conduct. $Q_1$ conduction is determined by the magnitude of $V_{be}$ and this magnitude is also dependent on $Q_1$'s junction temperature. Since $Q_1$ is not conducting, the $Q_1$ and $Q_2$ junction temperature will be determined by the case or heat sink temperature. Assuming that the case of $Q_1$ is at the same temperature as the LED array heat sink case, the following temperature relationship for $Q_1$ is determined.

$$V_{Toff}<V_{beth}+V_{tcT}(T_{jT}-T_{ref}) \tag{12}$$

$$T_{jT}=T_C=(m-pq)R_{c-a}V_{LED}I_{LED}+2qR_{c-a}V_{Ton}I_{LED}+T_A \tag{13}$$

Combining equations (12) and (13) leads to the below equation for $V_{Toff}$ as a function of Temperature:

$$V_{Toff}=V_{beth}+V_{tcT}[(m-pq)R_{c-a}V_{LED}I_{LED}+2qR_{c-a}V_{Ton}I_{LED}+T_A-T_{REF}] \tag{14}$$

Equation (9) gives the temperature variation that will be applied to the voltage divider comprising $R_1$ and $R_2$. Equation (14) shows the boundary conditions needed to be met by the voltage divider to prevent unwanted conduction of $Q_1$. These two equations are used to determine ratio, $R_1/R_2$, which will assure $Q_1$ stays off when the LED is functioning properly. The following analysis develops the conditions that can lead to the desired ratio of $R_1$ to $R_2$.

$$V_{off}=\frac{V_{SS}R_2}{R_1+R_2}+(I_{IZ}+I_{CE})\frac{R_1R_2}{(R_1+R_2)}<V_{Toff} \tag{15}$$

Because there will be some variation in the value of the cut-on voltage $V_{beth}$ from transistor to transistor, some additional protection should be allocated to the inequality of equation (15). Selecting a multiplier, α, to give a safety factor, leads to the following equation for the ratio $R_1/R_2$.

$$0<\alpha<1 \tag{16}$$

$$\frac{V_{SS}R_2}{R_1+R_2}+(I_{IZ}+I_{CE})\frac{R_1R_2}{R_1+R_2}\le\alpha V_{Toff} \tag{17}$$

$$k=\frac{R_1}{R_2}\Rightarrow\frac{V_{SS}}{1+k}+(I_{IZ}+I_{CE})\frac{kR_2}{1+k}\le\alpha V_{Toff} \tag{18}$$

$$k>\frac{V_{SS}-\alpha V_{Toff}}{\alpha V_{Toff}-(I_{IZ}+I_{CE})R_2}\approx\frac{V_{SS}}{\alpha V_{Toff}}-1; \tag{19}$$

$$\text{for } \alpha V_{Toff}>>(I_{IZ}+I_{CE})R_2$$

$$\alpha V_{Toff}<V_{Toff}=V_{beth}+V_{tcT}[(m-pq)R_{c-a}V_{LED}I_{LED}+2qR_{c-a}V_{Ton}I_{LED}+T_A-T_{REF}] \tag{20}$$

A second requirement of certain exemplary embodiments is that the Zener diode $D_1$ does not conduct while the LED is operating normally. The Zener diode is required to conduct current only during the short interval when $Q_I$ is triggered on. Therefore, the temperature of the Zener diode junction will be the same temperature as the case or heat sink. The Zener diode voltage must satisfy the following:

$$V_{SS}<V_z;\ I_Z\approx 0 \tag{21}$$

$$V_Z=V_{Zth}+V_{tcZ}(T_{jZ}-T_{REF}) \tag{22}$$

$$T_{jZ}=T_C=(m-pq)R_{c-a}V_{LED}I_{LED}+2qR_{c-a}V_{Ton}I_{LED}+T_A \tag{23}$$

$$V_{SS}<V_Z=V_{Zth}+V_{tcZ}[(m-pq)R_{c-a}V_{LED}I_{LED}+2qR_{c-a}V_{Ton}I_{LED}+T_A-T_{REF}] \tag{24}$$

For FIG. 4A-B:

$$(I_{IZ}+I_{CE})R_2\le\alpha V_{Toff} \tag{25}$$

The previous equations show temperature dependence of $V_{LED}$, $V_z$ and $V_{be}$. Resistors $R_1$ and $R_2$ are selected to be 1% resistors with ±100 ppm/° C. temperature coefficient. The value of k and α must be selected to insure the voltage $V_{be}$ for $Q_1$ meets the boundary requirements. Graphing the $V_{Toff}$, $\alpha V_{Toff}$, and $V_{SS}/(1+k)$ versus temperature will aid in selecting suitable parameter values for α and k. The parameter values used to produce the graph of FIG. 6 are: for $T_A$ ranging from −60° C. to +150° C., $V_{beth}$=0.6V, $V_{beon}$=0.7 Volts, $V_{tcT}$=−2.2 mV/° C., $V_{thL}$=2.95V, $R_d$=0.67Ω, $V_{tcL}$=−4 mV/° C., $R_{Lj-c}$=8° C./W, $I_{CE}$=50 μA, $I_{IZ}$=3 μA, m=84, $R_{Tj-c}$=8.3° C./W, p=1, and $R_{c-a}$=0.2° C./W, and $I_{LED}$=0.75 A.

Figure 6:
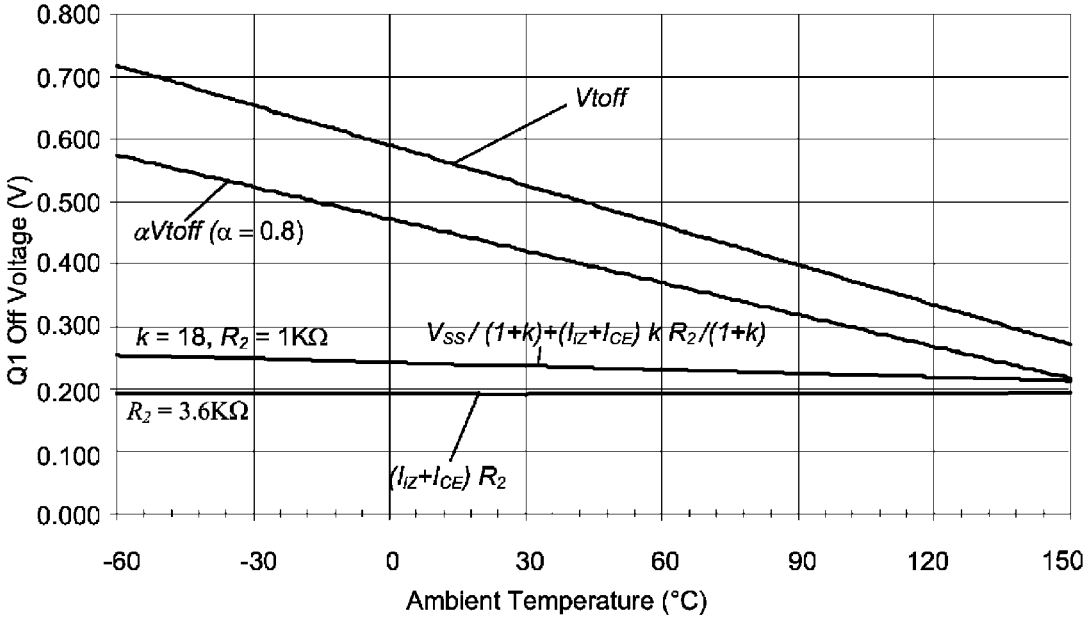
FIG. 6 is a graph of $V_{Toff}$, $\alpha V_{Toff}$, of equation (17) and equation (25) described later with p=1.

The graph in FIG. 6 shows that the slope of the line representing Equation (17) is much less than the slopes of the lines representing $V_{Toff}$ or $\alpha V_{Toff}$. Also, the lowest margin for keeping $Q_1$ off occurs at the highest temperature. A comfortable margin at high temperatures results when $R_2$=1000 ohms, α=0.8 and k=18. FIGS. 4A-B removes parameters $R_1$ and k leaving only the leakage currents $I_{IZ}$ and $I_{CE}$ to determine the value of $R_2$ that can be used. FIG. 6 shows the results for a value of $R_2$=3600 ohms. Resistor R2 should as large as possible to allow $Q_1$ $Q_2$ to remain in latched conduction when the low currents result with light dimming operations.

Analysis for Triggering $Q_1$ ON When LED is Open:

When an open LED sub-string is encountered, $Q_1$ in FIG. 3A must turn on, and then turn on $Q_2$ to provide a current path around the open LED sub-string. As stated before, once both $Q_1$ and $Q_2$ turn on, a latch is formed that provides a bypass around the LED sub-string. This current path will be maintained until the current in that path is forced to go near zero. When the LED sub-string is open, the voltage across the open sub-string will go toward the magnitude allowed by the power source. The power source open circuit magnitude must be sufficient to cause the base voltage of $Q_1$ in FIG. 3A to exceed $V_{be}$ by a margin sufficient to cause collector current $I_{C1}$, to be sufficient to turn on $Q_2$. The voltage $V_{be}$, must be substantially greater than 0.7 volts at 25° C. to insure full conduction of $Q_1$. The $V_{SS}$ open circuit voltage at which $Q_1$ turns on is called $V_{trig}$. Once $Q_2$ is on, the positive feedback of $I_{C2}$ latches $Q_1$ on, and causes the voltage $V_{SS}$ to drop to the value of $V_{be1}+V_{be2}$. The following equations relate to the turn on of $Q_1$ to latch the shunt circuit bypassing the open LED. The cut-on voltage $V_{beth}$, is replaced with $V_{beon}$. Note that the Zener diode current will not be zero during triggering. The duty cycle for the Zener current will be approximately 0.5% during PWM operation. Initially, $I_Z$ will peak at nearly $I_{LED}$ until $Q_1$ and $Q_2$ start conducting current.

$$\frac{(V_{trig}-V_Z)R_2}{R_z+R_2}\ge V_{Ton}\Rightarrow V_{trig}\approx V_{Ton}+V_Z;\ \text{for } R_2>>R_z \tag{26}$$

$$V_z=V_{Zth}+I_ZR_z+V_{tcZ}(T_{jZ}-T_{ref}) \tag{27}$$

$$I_Z=I_{LED}-I_{b2}-I_{C2}-\frac{V_z}{(R_3+R_2)}\approx I_{LED} \tag{28}$$

$$T_{jZ}=R_{Zj-c}(R_zI_{LED}+V_{Zth})I_{LED}0.005+(m-pq)R_{c-a}V_{LED}I_{LED}+2qR_{c-a}V_{Ton}I_{LED}+T_A \tag{29}$$

$$V_{trig}\ge V_{beon}+V_{Zth}+0.005R_{Zj-c}V_{tcZ}(R_zI_{LED}+V_{Zth})I_{LED}+(V_{tcT}+V_{tcZ})[(m-pq)R_{c-a}V_{LED}I_{LED}+2qR_{c-a}V_{Ton}I_{LED}+T_A-T_{REF}] \tag{30}$$

Equations (26) through (30) apply for the circuits shown FIGS. 3A-B and 4A-B.

$$\frac{(V_{trig})}{1+k} \geq V_{Ton} = V_{beon} + V_{tcT}(T_{jT} - T_{REF}) \tag{31}$$

$$V_{trig} > (1+k)\{V_{beon} + V_{tcT}[(m-pq)R_{c-a}V_{LED}I_{LED} + 2qR_{c-a}V_{Ton}I_{LED} + T_A - T_{REF}]\} \tag{32}$$

Equations (31) and (32) apply for the circuits shown in FIG. 2A-B.

Figure 7:
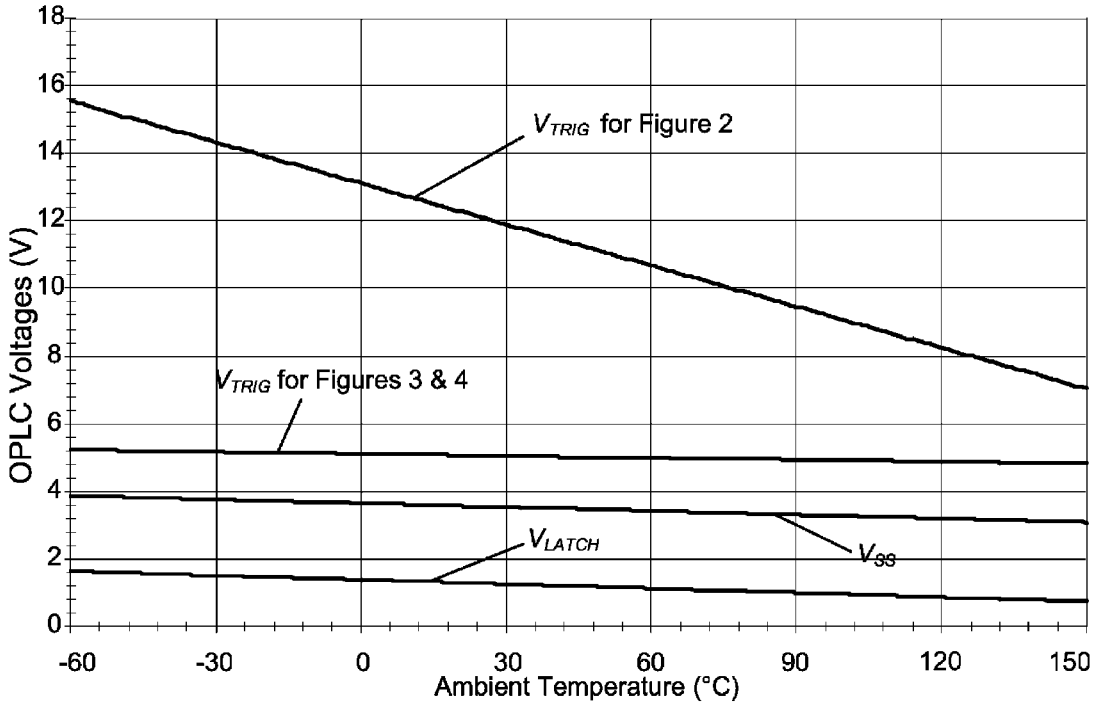
FIG. 7 is a graph showing $V_{trig}$, $V_{SS}$, and $V_{latch}$ with p=1.

FIG. 7 shows a graph of the $V_{trig}$ boundary for the circuits of FIGS. 2A-4B as a function of the ambient temperature. The graph of FIG. 7 use the same parameter values used to determine the α and k values which were used for the graph of FIG. 6, with the exception of a change in the cut-on voltage $V_{beth}$, value to 0.7 volts at 25° C. The added parameter values (at 25° C.) used for the Zener diode are: $V_{zth}$=3.79 V and $R_z$=80Ω. FIG. 7 also shows a plot of $V_{SS}$ as temperature varies for comparison with $V_{trig}$. As shown in the graph of FIG. 7, it is important when using FIG. 2A-B in the application, that a minimum value for k be used to minimize the magnitude of $V_{trig}$. Conflicting requirements for the value of k include the need to maximize k to hold off the conduction of $Q_1$ when the LED sub-string is functioning normally, and the need to minimize the value for k to keep the value of $V_{trig}$ low. For the circuits of FIGS. 3A-B and 4A-B, the value of $V_z$ needs to be large enough to keep $Q_1$ from turn-on when the LED sub-string is functioning, but small enough to keep $V_{trig}$ low.

If more than one LED sub-string should fail open, a greater power source voltage must be available to cause the increased number of OLPCs to trigger. For example, if there are 10 LEDs in series with each LED having an OLPC, the power source would be required to provide approximately 40 Volts to operate the LEDs at the lowest temperature. If one open LED occurs, the required power source voltage would become 38.4 volts plus the largest trigger voltage. The greatest trigger voltage will be found at the lowest operating temperature for negative coefficient devices or the highest operating temperature for positive temperature coefficient devices. From FIG. 7, the power source would need to furnish an additional 8.5 Volts ($V_{trig}$−p$V_{LED}$). Therefore, for each additional LED sub-circuit n failure allowed, the power source must be able to provide an additional n times 8.5 volts in order to activate the OLPC.

Once the latches have been triggered on, the voltage $V_{SS}$ drops to $V_{latch}$, the sum of the voltages $V_{be1}$ and $V_{be2}$ of FIG. 5. As a result, the power dissipation of the LED sub-string is reduced to approximately half the power of one LED. Transistors $Q_1$ and $Q_2$ are now dissipating half of the power previously being dissipated by one LED in the LED sub-circuit. The two voltages, $V_{be1}$ and $V_{be2}$ are both temperature dependent and each have approximately the same magnitude. The temperature characteristics are now given by the following equations:

$$V_{latch} = V_{be1} + V_{be2} \approx 2V_{be} \tag{33}$$

$$V_{be} = V_{beon} + V_{tcT}[(m-pq)R_{c-a}V_{LED}I_{LED} + 2qR_{c-a}V_{Ton}I_{LED} + T_A - T_{REF}] \tag{34}$$

$$V_{latch} = 2V_{be} = 2\{V_{beon} + V_{tcT}[(m-pq)R_{c-a}V_{LED}I_{LED} + 2qR_{c-a}V_{Ton}I_{LED} + T_A - T_{REF}]\} \tag{35}$$

FIG. 7 shows the magnitude of the voltage $V_{latch}$, is approximately half the value of $V_{LED}$. The power source voltage must adjust to the new output voltage required for the total series string but maintain the same output current. In addition, the power source voltage must provide sufficient voltage $V_{Supply(min)}$ to trigger the protection circuit on.

Equations (36) through (38) describe the power source voltage required to trigger and sustain operation of one or more OLPCs in a series string of LED substrings protected by OLPCs: A total number m of LEDs connected in series that has some number q, of open LED sub-circuits, will require a power source voltage that is determined by the following equations. In the following equations the resistor $R_W$, accounts for any wiring losses in connecting the LED sub-circuits together and/or to the power source. For any array, this would be the wiring between the power source and the array. For applications having isolated LEDs connected in series, $R_W$ accounts for the wiring voltage drops between individual LEDs. Equation (36) indicates power source voltage $V_{supply(Trig\ min)}$ needed to trigger the OLPC. Once the OLPC circuit triggers, the required power source voltage drops to the value necessary to sustain LED operation. Equation (37) indicates that the power source sustaining voltage $V_{Supply(sustain\ min)}$ is significantly lower than the voltage needed to trigger the OLPC. Equation (38) indicates that the voltage overhead $V_{overhead}$ which is the difference between the power source trigger voltage and the power source sustaining voltage. This voltage is a determined by the number of sub-string failures accepted q and the number of series connected LEDs p in a sub-string.

$$V_{Supply(Trig\ min)} = q(V_{trig(max)} + V_{latch}) + (m-pq)V_{LED} + R_W I_{LED} \tag{36}$$

$$V_{Supply(Sustain\ min)} = qV_{latch} + (m-pq)V_{LED} + R_W I_{LED} \tag{37}$$

$$V_{overhead} \geq qV_{beon} + qV_{Zth} + 0.005qR_{Zj-c}V_{tcZ}(R_Z I_{LED} + V_{Zth})I_{LED} + q(V_{tcT} + V_{tcZ})[(m-pq)R_{c-a}V_{LED}I_{LED} + 2qR_{c-a}V_{Ton}I_{LED} + T_A - T_{REF}] \tag{38}$$

Figure 8:
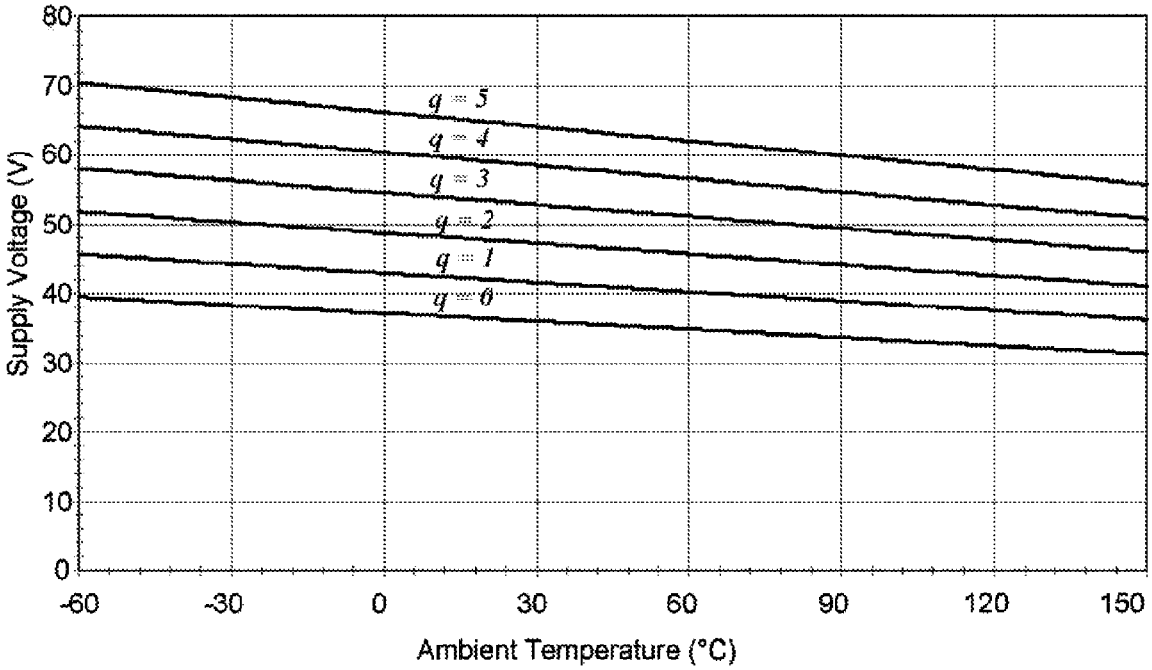
FIG. 8 is a graph of LED required power source voltage when m=10, p=1, and $0 \leqq q \leqq 5$.

As the number p, of LEDs used in the sub-string increases, the value of $V_z$ will increase. As a result, the temperature coefficient of $V_z$ becomes more positive and will cause the value of $V_{Supply(min)}$ to be determined by the highest operating temperature requirements of the system, where $V_{trig(max)}$ occurs. Equation (36) indicates that value needed for $V_{trig(max)}$ and the number of LED sub-strings allowed to fail, will define the LED driver or power source maximum output voltage requirements. A graph of equation (36) showing values for $V_{Supply(Trig\ min)}$ vs. temperature is shown in FIG. 8, with m=10, p=1, and q ranges from 0 to 5.

Figure 9:
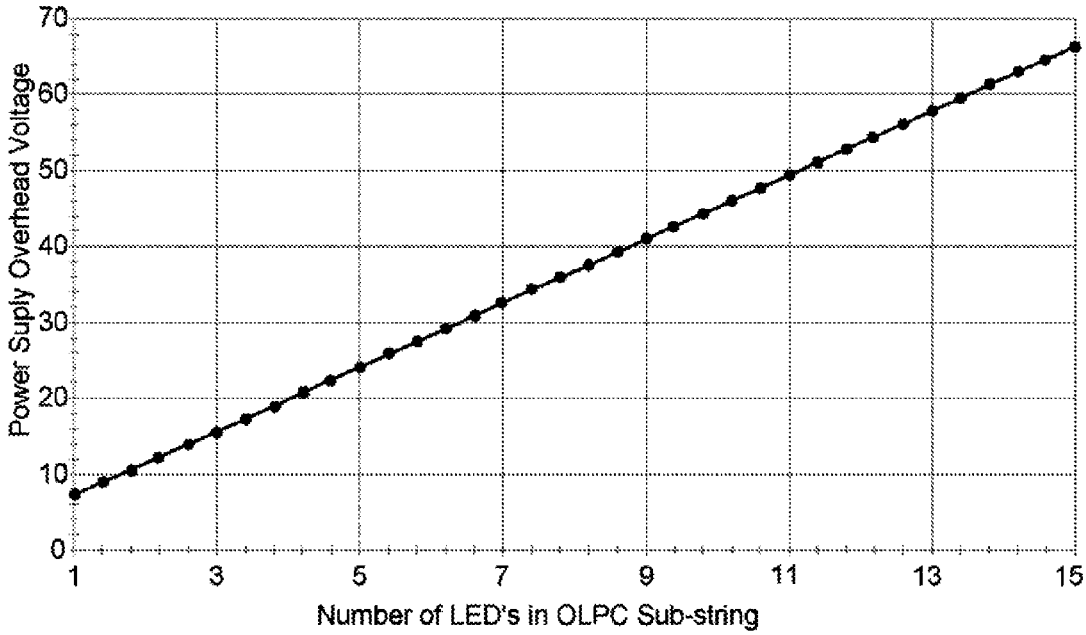
FIG. 9 is a graph of power source overhead voltage for number of LEDs in a sub-string with q=1.

The value of $V_{Zth}$ increases asp increases. Modifying Equation (38) for $V_{Zth}$ to be scaled by the value of p produces a graph of $V_{overhead}$ as a function of p with q=1 and at a fixed ambient temperature. The maximum voltage overhead will occur at the minimum ambient temperature provided $V_{Zth}$ has a negative temperature coefficient. The Voltage overhead graph shown in FIG. 9 assumes a minimum ambient temperature of −40° C., and a 4.7 Volt Zener diode as the model in scaling Equation (38) to produce Equation (39) for use in plotting FIG. 9.

$$V_{overhead} = qV_{Trig} = q\left\{\begin{array}{c} V_{beon} + pV_{Zth(4.7)} + 0.005pR_{Zj-c(4.7)}V_{tcZ} \\ (R_{Z(4.7)}I_{LED} + V_{Zth(4.7)})I_{LED} + \\ (V_{tcT} + pV_{tcZ(4.7)}) \\ [(m-pq)R_{c-a}V_{LED}I_{LED} + \\ 2qR_{c-a}V_{Ton}I_{LED} + T_A - T_{REF}] \end{array}\right\} \tag{39}$$

Summary:

The previous analysis has led to the generalized set of equations that take into account temperature effects in designing an LED array that include OLPC. Graphs showing the relationship between the various parameters used are easily constructed from these equations. An important objective in using these equations is to produce a design that minimizes $V_{trig}$ and determines the value of $V_{supply(min)}$. The component values for $R_1$ and $R_2$ determine the current magnitude where $Q_1$ and $Q_2$ will stop conducting $I_{LED}$ once the OLPC becomes latched. These resistors also must be selected to assure false triggering does not occur due to the leakage currents from $Q_1$ and $Q_2$. Capacitors $C_1$ and $C_2$ provide filtering for transients and prevent $Q_1$ and $Q_2$ from false triggering. The values of $C_1$ and $C_2$ are influenced by the value of $C_{CE}$ of transistors $Q_1$ and $Q_2$ because these components form a capacitor divider across $V_{SS}$.

$$\frac{V_{Ton}}{I_{LED(min)}} < R_1 = R_2 < \frac{V_{off}}{(I_{bias} + I_{CEO} + I_{IZ})} \tag{40}$$

$$C_1 = C_2 > kC_{CE} \tag{41}$$

For FIGS. 2A-B and 3A-B;

$$R_1 \leqq kR_2 \tag{42}$$

For FIGS. 3A-B and 4A-B;

$$V_z > V_{SS} + V_{Ton} \tag{43}$$

Transistors $Q_1$ and $Q_2$ will share the current $I_{LED}$, when the OLPC is active. The sum of $I_{C1}$ and $I_{C2}$ must be equal to $I_{LED}$. If complementary transistors are used for $Q_1$ and $Q_2$, then each collector current will be approximately equal to $I_{LED}/2$. As shown by the following equations, the base current specification for $Q_1$ and $Q_2$ must be capable of magnitudes approaching the value of $I_{LED}$.

$$I_{B1} \approx I_{C2} \tag{44}$$

$$I_{B2} \approx I_{C1} \tag{45}$$

$$I_{E_1} = I_{E2} \approx I_{LED} \tag{46}$$

$$I_{C1} + I_{C2} = I_{LED} \tag{47}$$

The power source must satisfy two criteria. First, it must be large enough to supply $V_{trig}$ to activate the OLPC at the specified maximum number of open LED sub-circuits. Secondly, it must adjust to the needed voltage for the number of active OLPC and the remaining active LEDs without modifying the set current magnitude. The power source voltage requirements as the temperature varies are given in the following equations:

For FIG. 2A-B:

$$V_{trig} > (1+k)\{V_{be} + V_{tcT}[(m-pq)R_{c-a}V_{LED}I_{LED} + 2qR_{c-a}V_{Ton}I_{LED} + T_A - T_{REF}]\} \tag{48}$$

$$k > \frac{V_{SS} - \alpha V_{Toff}}{\alpha V_{Toff} - (I_{IZ} + I_{CE})R} \approx \frac{V_{SS}}{\alpha V_{Toff}} - 1; \tag{49}$$

for $\alpha V_{Toff} >> (I_{IZ} + I_{CE})R_2$

For FIGS. 3A-B and 4A-B:

$$V_{trig} \geqq V_{beon} + V_{Zth} + 0.005R_{Zj-c}V_{tcZ}(R_zI_{LED} + V_{Zth})I_{LED} + (V_{tcT} + V_{tcZ})[(m-pq)R_{c-a}V_{LED}I_{LED} + 2qR_{c-a}V_{Ton}I_{LED} + T_A - T_{REF}] \tag{50}$$

For the power source voltage:

$$V_{Supply(Trig\ min)} = q(V_{trig(max)} + V_{latch}) + (m-pq)V_{LED} + R_{ip}I_{LED} \tag{51}$$

E. Additional Exemplary Method and Embodiment

The three circuits of FIGS. 10A-C are similar ways of providing an alternate path for the total current of an open LED.

FIG. 10A shows an electronic circuit according to an exemplary embodiment placed in parallel with each series connected LED or group of series connected LEDs. When an open circuit failure of an LED or series group occurs, an alternate conduction path around the open LED or series group is formed and only the illumination provided by the single LED or protected group is eliminated, rather than that provided by the entire string of series connected LEDs. Alternatively, when a short circuit failure of an LED occurs, the illumination of the failed LED is not present, the bypass circuit is not activated, and the remaining LEDs remain lit since they continue to be supplied series current through the shorted LED. Consequently, with the added electronic circuit, the operation of the series connected LED string is essentially the same for either a short circuited or open circuited LED failure.

FIG. 10B shows an electronic circuit that functions similarly to FIG. 10A using a PNP transistor and an NMOS FET. The advantage of FIG. 10B over FIG. 10A is that the threshold voltage of activation can be adjusted easily without having to change semiconductor devices.

FIG. 10C shows a circuit that functions similarly to FIG. 10A using a PNP transistor and an NPN transistor. The advantage of FIG. 10C over FIGS. 10A and 10B, is that a lower threshold voltage can be obtained when high currents must be bypassed.

All three circuits of FIGS. 10A-C will provide an alternate path for the total current of an open LED. The voltage drop across the shunt path must be slightly higher than the operating LED was at maximum current. Consequently, the power dissipation of the alternative circuit path when active will be slightly greater than the operating LED. It should be noted that while FIG. 10A shows a single LED and FIGS. 10B and 10C show a string of LEDs, any of the circuits may be used with either a single LED or string of LEDs as desired.

FIG. 11A shows a single semiconductor device known as an SCR connected in parallel with an LED. Resistors R9 and R10 form a voltage divider to develop a trigger voltage to the SCR when the LED fails open. Because the open circuit voltage across the LED will try to reach the voltage applied to the series LED string, the trigger voltage is sufficient to trigger the SCR on. The impedance of the voltage divider must be low enough to provide the SCR specified gate current. Once the SCR is triggered, the voltage across the LED will decrease to approximately 1.4 volts in this example. Conduction of the SCR will continue as long as the current is greater than the sustaining current, and the voltage dropped across the SCR is above the sustaining voltage. Conduction will cease when either the voltage or the current drops below the respective sustaining magnitudes. Once triggered, the voltage applied to the gate does not need to maintain any threshold.

The circuit of FIG. 11B is a transistorized circuit that functions similarly to FIG. 11A. The electronic bypass circuit comprises transistors Q35, Q36, R20, and R21. Additional components, such as diodes or resistors, may be added in order to produce a voltage match to the operating LED if necessary. When activated, the total power dissipation of the bypass circuit is less than or equal to the power dissipation of the functioning LED or LEDs that it replaces. The advantage of FIG. 11B is that the trigger current and the sustaining current can be modified and determined by the gain of the transistor and by the resistive components. In addition, R20 and R21 provide values that can be used to adjust the conduction voltage to match or track the operational LED forward voltage. The circuit of FIG. 11B can be preferred in many situations. The circuit of FIG. 11C is another transistorized circuit that functions similarly to FIG. 11A. The circuit of FIG. 11D is a circuit similar to FIG. 11B with a Darlington transistor configuration which increases the transistor gain which maybe desirable in some circumstances.

The purpose of these circuits is to provide an alternate current path around an open LED failure in a series connected string of LEDs in order to maintain the original current magnitude in the remaining operational LEDs. The circuit provides a path that has the same magnitude of current as the functioning LED and has a voltage drop that is less than or equal to the voltage drop of the functioning LED. Once the alternate current path is established, the alternate path remains operational until power is removed (and is reestablished once power is again applied. In addition, the alternate conducting path is able to operate over the entire LED operating current range.

FIG. 12 shows an array of LEDs within a single circuit with bypass circuits such as described above included. When an LED fails and becomes an open circuit, the voltage applied to the entire series LED string will appear across the open LED, which will trigger the alternate circuit ON causing a low impedance shunt to appear across the open LED. Once the circuit is triggered ON, the circuit is latched ON and the current will continue in the alternate path until the string current falls below a sustaining current value, or the voltage applied to the string falls below a sustaining voltage. The sustaining current is determined by the values of the resistors and current gain of the transistor. The sustaining voltage is established by the transistor base emitter junction voltage.

F. Additional Method and Embodiment

FIG. 13 shows an alternate embodiment wherein the series connected LEDs can be broken into groups such that one circuit protects a number of LEDs. For example, one open LED bypass circuit would protect a group of, e.g., 10 LEDs. So if one LED failed as an open circuit in a series circuit of, e.g., 100 LEDs, a bypass circuit would bypass a group of 10 LEDs including the failed LED, leaving 90 out of the hundred LEDs operational. Since the LED string is driven by a current source, the voltage across the string will adjust to the correct value for the reduced number of active LEDs. The fixtures can be connected as an array of lights which may include a bypass circuit for each light, or for several lights as part of a string. If the configuration is set to bypass several fixtures if one light fails, the fixtures can potentially be wired so that alternating lights will be out, rather than several lights in a row.

FIG. 14 shows an additional embodiment where several strings of LEDs are included in a single fixture or system of fixtures having OLPC protection for each substring. Each string has a separate current driver.

G. Additional Method and Embodiment

The circuits shown in FIGS. 15-17D provide an alternative circuit configuration that can be used to provide OLPC operation. The circuits of FIGS. 16A-D and 17A-D are functionally similar to the simpler circuit shown in FIG. 15.

The OLPC circuit of FIG. 15 is a Zener diode D1, that conducts the current of the LED series sub-string when any one of the diodes, LED1-LEDP, becomes open circuited. When an open circuit occurs, the voltage across the sub-string containing the open LED will try to attain the LED power source (or driver) open-circuit voltage, but the sub-string voltage will be clamped to the reverse breakdown voltage of the Zener diode D1, and all of the current that was going through the sub-string will now be conducted by the Zener diode. To prevent the Zener diode from conducting current when the LED sub-string is functioning properly, the magnitude of the Zener reverse breakdown voltage must be greater than the LED sub-string maximum forward voltage. As a result of the larger operating voltage for an activated Zener diode OPLC, the power dissipation of the activated OLPC will be greater than the power dissipation of the functioning LED sub-string it protected. The Zener diode form of the OLPC will be designated ZOLPC for the remainder of the discussion.

The ZOLPC does not form a latching circuit so a triggering voltage is not required. Conduction is determined only by the magnitude of the voltage applied to the ZOLPC, and as a result, any false conduction would quickly be extinguished by the lower conduction voltage of a parallel operating LED sub-string. Therefore, the maximum power source open-circuit voltage needed to assure operation of the ZOLPC will be determined by total number of series LEDs plus the number of operating LED sub-strings plus the maximum voltage of the ZOLPC times the number of allowed active ZOLPCs.

Since the ZOLPC does not form a latching circuit and the implementation requires the ZOLPC to have a slightly greater conduction threshold voltage than the parallel LED substring, the power dissipated by the ZOLPC will be significantly greater than the power dissipated by the protected LED sub-string, should an LED in the sub-string become open circuited. The power dissipation for LED sub-strings containing more than 1 or 2 LEDs may become prohibitive for the ZOPLC arrangement. For this reason, this shunt circuit configuration is not the preferred circuit configuration for the OLPC.

The simple circuit shown in FIG. 15 only requires a Zener diode to construct the ZOLPC. When used to protect a high power LED, 1 Watt or more, it requires a power Zener diode. Power Zener diodes are not readily available in the market place and are expensive devices. FIGS. 16A-D show various ways to shift the power dissipation of the zener diode to a power transistor or power FET. For all the circuits shown in FIG. 16A-D, the Zener diode is used only to hold the power device off until an open LED in the sub-string occurs. Once an open circuit in the LED sub-string exists, the voltage across the ZOLPC will automatically rise towards the open circuit voltage of the power source. When the voltage exceeds the Zener diode reverse breakdown voltage, a current flows through the diode and will turn on the power transistor. The current gain of the power transistor is used to produce negative current feedback to the positive terminal of ZOLPC clamping the voltage across the LED sub-string to a value slightly greater than the Zener voltage. The power transistor now conducts the current that originally was conducted by the LED, minus the current needed to bias the power transistor on. The power dissipation in the clamping transistor is approximately the voltage across ZOLPC time the current $I_{LED}$. All the circuits in FIG. 16A-D provide the same function and can be implemented with power transistor types NPN, PNP, NMOS FETs, or PMOS FETs.

The gain of the power transistor will influence the voltage across the ZOLPC. If the gain of the power transistor is low, there will be an increase in the voltage across the ZOLP as the series current applied to the LED Lighting System is increased. FIGS. 17A-D show a two transistor ZOLP configuration which can be implemented to increase the gain of the system and reduce the change in voltage across the ZOLPC as the LED Lighting System current increases. Transistors $Q_1$ in FIGS. 17A-D provide additional current gain to bias the power transistors $Q_2$ on. Because of the added gain, any increase in voltage across ZOLPC gets amplified and causes the current through the power device to increase, producing a tighter clamp on the voltage magnitude across ZOLP.

The temperature characteristics of the LED and the ZOLPC devices are important parameters that must be considered in the design. In order to minimize the power dissipation of the active ZOLPC, all components should have negative temperature coefficients to match the negative temperature coefficient of the LEDs. The ZOLPC is not a preferred embodiment of the invention, so the temperature analysis is not included here.

FIG. 18 shows a graph of the operating voltages for LED, the OLPC, and a single transistor and two-transistor ZOLPC for a protected single LED sub-string. FIG. 19 shows a graph of the power dissipation of the LED, the OLPC, and a single transistor and two-transistor ZOLPC for a protected single LED sub-string. For a protected sub-string with multiple LEDs, the OLPC trigger voltage will increase but not the active voltage of the OLPC. Consequently, the power dissipated by the active OLPC does not increase with the number of LEDs in the substring. For the ZOLPC, the active voltage must increase to accommodate the increased voltage of the sub-string when the LEDs are active. Since the ZOLPC active voltage is higher, the power dissipated by active ZOLPC will also increase as the number of LEDs protected in the sub-string increases. FIG. 20 shows a graph of operating voltage when a protected 3-LED sub-string is implemented. FIG. 21 shows a graph of power dissipation when a protected 3-LED sub-string is implemented.

These graphs are valid representations for operation at 25° C. and show the performance difference one can expect from the various circuit arrangements described. The value of the voltage where the ZOLPC circuit becomes active must be adjusted to insure the ZOLPC circuit is not active at the LED Sub-string operating voltage at the lowest temperature. Similarly, the trigger voltage of the OLPC circuit must be greater than the LED Sub-string operating voltage at the lowest temperature.

H. Additional Method and Embodiment

FIG. 22 illustrates a view of an embodiment similar to FIG. 13 wherein an array of LEDs is distributed over several fixtures. A grouping of bollard type pathway light fixtures 100 are arranged along and provide illumination 40 for pathway 42. These fixtures enclose one or more LEDs within each housing.

FIG. 23 illustrates a plan view of this type of installation. Fixtures 100 are connected by means of circuit 740. Driver 710 provides power to circuit 740 and could be located remotely or within one of the fixtures. Fixtures 100 include one or more LEDs and a bypass circuit. If the LED or LEDs in one fixture fail, the rest of the fixtures remain illuminated.

FIG. 24 illustrates a similar installation having two series circuits 840 and 850 which power alternate lamps 100 and 200. Control 810 can contain separate bypass circuits for groups of fixtures 100 and 200. If a single lamp 100 fails open, the bypass circuit will bypass circuit 840. The remaining lamps 100 will not be illuminated, but circuit 850 will still be receiving power. Lamps 200 will remain illuminated. Note that many circuits could be provided, with each circuit having two or more fixtures or LEDs per circuit. Depending on the application and wiring costs (including burial, conduit use, terrain, etc.) it could be advantageous to configure this system with various types of bypass systems. These systems could allow a bypass circuit for each LED or single-LED fixture, a bypass circuit for multiple LEDs within a fixture, or for multiple fixtures. For instance, these groups of LEDs or fixtures could be distributed such that in the event of a single bypass, no two lights in close proximity would be disabled which could still allow use of the pathway. Alternatively, several LEDs or fixtures in a row might be wired as part of a single string, all of which would be bypassed in the event of an open LED. This might be more appropriate where generalized lighting is more available in addition to the pathway lighting.

What is claimed is:

1. A method for controlling a string of multiple light sources operatively connected in series and powered by a driver circuit having an unloaded power source voltage by providing an alternative current path around each of one or more substrings having one or more of the multiple light sources, each substring having an operating voltage comprising:

(a) allowing significantly less than operating current through the alternative current path until an open circuit condition in the substring indicative of a failure of a lighting source of the substring; and (b) triggering substantially all operating current to pass through the alternative current path of the substring by a triggering voltage which is effective over a range of ambient temperatures and operating conditions by the unloaded power source voltage of the driver circuit being greater than the operating voltage of the substring and the trigger voltage needed over the temperature range;

(c) to allow operating current to automatically bypass the substring of light sources including the light source or sources sensed to have failed so it is available for other light sources in the string over the range of ambient temperatures and operating conditions.

2. The method of claim 1 further comprising passing essentially 100% of the operating current around the failed lighting source.

3. The method of claim 1 further comprising multiple strings of light sources in operative connection.

4. The method of claim 1 further comprising adjusting or trimming voltage and/or current so that operating voltage and current to the other light sources can be maintained when a single light source open failure occurs.

5. The method of claim 1 further comprising detecting an open failure by monitoring voltage relative to a pre-set triggering voltage.

6. The method of claim 1 wherein the alternative current pathway is not activated on a short circuit of a single light source.

7. The method of claim 1 wherein the alternative current pathway is operated until power drops below a certain level or is removed from the circuit.

8. The method of claim 1 wherein the light source comprises a solid state source.

9. The method of claim 1 wherein the bypass occurs at a predesigned triggering voltage and the alternative current path is latched to active for any of the following conditions;

(a) the sensed failure occurs while operating power is through the multiple light sources; or (b) the failure occurs before operating power is applied to the multiple light sources.

10. An apparatus for controlling multiple light sources powered by a driver circuit to provide alternative failure mode when one or more individual light source fails, comprising:

(a) an alternative current path circuit in parallel with a subset of the multiple lighting sources, the alternative current path circuit having at least one component having a temperature characteristic related to ambient temperature or operating conditions;

(b) the alternate circuit path current being significantly less than the single lighting source current such that when the single light source open failure occurs, the alternative circuit triggers and passes on the order of 100% of the single lighting source current to maintain current to the other lighting sources, the temperature characteristic of the component and the driver circuit correlated to provide sufficient power to the alternative current path for effective triggering over a selected range of ambient temperatures or operating conditions.

11. The apparatus of claim 10 further comprising producing voltage drop that is less than the light source operating voltage.

12. The apparatus of claim 10 further comprising a component to adjust or trim operating voltage and/or current that can he maintained when a light source open failure occurs.

13. The apparatus of claim 10 wherein the circuit is electronic or primarily electronic.

14. The apparatus of claim 10 wherein the light source comprises a solid state lighting source.

15. The apparatus claim 10 wherein the circuit comprises a zener diode, a PNP transistor and an NMOS FET, a PNP transistor and an NPN transistor, an SCR, or a transistorized circuit.

16. The method of claim 1 wherein the triggering voltage is calibrated by selection of components of an alternate current path circuit according to anticipated system operating temperature range where under the entire temperature range the triggering voltage allows a plurality of open LED strings without exceeding the available open circuit voltage of the power source.

17. The method of claim 16 where the anticipated system operating temperature is 32° F. (0° C.) to 300° F. (150° C.).

18. The method of claim 16 where the anticipated system operating temperature range is 0° F. (−18° C.) to 300° F. (150° C.).

19. The method of claim 16 where the anticipated system operating temperature is −40° F. (−40° C.) to 300° F. (150° C.).

20. The method of claim 16 where the anticipated system operating temperature is −75° F. (−59° C.) to 300° F. (150° C.).

21. The method of claim 1 wherein the triggering voltage (Vtrig) is no more than four times the substring voltage (Vss) for an LED substring containing a single LED at −60° C. and is no more than 2.5 times the voltage Vss at 150° C.

22. The method of claim 21 wherein the predesigned triggering voltage Vtrig is no more than 135% of the voltage Vss for an LED substring containing a single LED at −60° C. and is no more than twice the voltage Vss at 150° C.

23. The method of claim 21 wherein the LED substring contains a plurality of the value (p) LEDs and the values for the triggering voltage Vtrig and substring voltage Vss are substantially equal to (p) times the values for the single LED values.

24. The method of claim 22 wherein the LED substring contains a plurality of the value (p) LEDs and the values for the triggering voltage Vtrig and the substring voltage Vss are substantially equal to (p) times the values for the single LED values.

25. The method of claim 9 wherein the latched operation is maintained during dimming operations for lowest dimming values of operating current.

26. The method of claim 25 wherein the lowest dimming values of operating current are 50% or less than the full value of operating current.

27. The method of claim 25 wherein the lowest dimming values of operating current are 20% or less than the full value of operating current.

28. The method of claim 25 wherein the lowest dimming values of operating current are 10% less than the full value of operating current.

29. The method of claim 9 wherein latch triggering occurs under one or more of the following operating conditions:

a. when the light source becomes open circuited while the LED circuit has power applied;

b. when the light source open circuited and power is applied.

30. The method of claim 29 wherein latch must release and then re-trigger when current is pulsed while using pulse width modulation (PWM) dimming or other dimming methods using variably switched current while an open-circuited LED substring exists.

31. The method of claim 30 such that the voltage that appears across each open circuit can attain the power source open circuit voltage divided by the number q, of open LED substring circuits and the open circuit power source voltage can exceed q times Vtrig.

32. The method of claim 31 wherein the potential power source open circuit voltage is no more than two times the normal operating circuit voltage.

33. The method of claim 31 wherein when q>=3, there is a limit to the number q of open LED substrings that can be accommodated by the power source.

* * * * *